US009777993B1

(12) United States Patent
Donahoe

(10) Patent No.: US 9,777,993 B1
(45) Date of Patent: Oct. 3, 2017

(54) APPARATUS, SYSTEM AND METHOD FOR ARCHERY SIGHT TAPE SELECTION

(71) Applicant: Full Flight Technology, LLC, Cambridge, MA (US)

(72) Inventor: Robert V. Donahoe, Newton, MA (US)

(73) Assignee: Full Flight Technology, LLC, Cambridge, MA (US)

( * ) Notice: Subject to any disclaimer, the term of this patent is extended or adjusted under 35 U.S.C. 154(b) by 0 days.

(21) Appl. No.: 15/006,826

(22) Filed: Jan. 26, 2016

Related U.S. Application Data

(60) Provisional application No. 62/107,679, filed on Jan. 26, 2015.

(51) Int. Cl.
*G06F 19/00* (2011.01)
*G06G 7/80* (2006.01)
*F41G 1/467* (2006.01)

(52) U.S. Cl.
CPC ..... *F41G 1/467* (2013.01)

(58) Field of Classification Search
CPC ..... F41G 1/467; F41G 5/1403; F41G 11/00; G06F 3/484; G06F 3/0488
USPC ..... 235/404–407
See application file for complete search history.

(56) References Cited

U.S. PATENT DOCUMENTS 4,617,741 A 10/1986 Bordeaux et al.
6,154,971 A 12/2000 Perkins
7,475,485 B1 * 1/2009 Hamm ..... F41G 1/467 124/87
7,614,156 B1 11/2009 Imig
7,972,230 B2 7/2011 Donahoe
8,221,273 B2 7/2012 Donahoe
8,914,986 B1 12/2014 Forouhar
9,141,215 B2 9/2015 Donahoe
9,441,913 B1 9/2016 Donahoe
2003/0101604 A1 6/2003 McGivern
2009/0165314 A1 7/2009 Khoshnood
2010/0115778 A1 5/2010 Gorsuch et al.
2011/0120438 A1 5/2011 Samuels et al.
(Continued)

OTHER PUBLICATIONS

The Archery Program,"https://web.archive.org/web/20131209025101/http://thearcheryprogram.com/index.php?option=com_content&view=article&id=2&Itemid=5" (2013).*

(Continued)

*Primary Examiner* — Laura Gudorf
(74) *Attorney, Agent, or Firm* — Rhodes Donahoe, LLC; Robert V. Donahoe

(57) ABSTRACT

A system includes at least one processor; a memory configured to store for each of the plurality of sight tapes, a first distance separating two sight marks included on each of the plurality of sight tapes, respectively, the two sight marks including a first sight mark associated with a first known shot-distance and a second sight mark associated with a second known shot-distance; a sight setting module configured to determine sight settings for the selected archery equipment and determine a second distance separating a first sight setting associated with the first known shot-distance and a second sight setting associated with the second known shot-distance; and a comparison module configured to compare a value of the second distance with a value of the respective first distances to determine which of the respective first distances most closely matches the second distance.

17 Claims, 14 Drawing Sheets

(56) References Cited

U.S. PATENT DOCUMENTS

| | | | |
|---|---|---|---|
| 2011/0297744 | A1 | 12/2011 | Schneider et al. |
| 2014/0144030 | A1 | 5/2014 | Heaton et al. |
| 2015/0089823 | A1 | 4/2015 | Garrone |

OTHER PUBLICATIONS

Archers Advantage—Palm Software, Oct. 4, 2006, retrieved from Internet Archives May 21, 2015, https://web.archive.org/web/20061004081813/http://www.archersadvantage.com/AdPages/AAPalm.htm.

Archers Advantage—Windows Software, Oct. 4, 2006, retrieved from Internet Archives May 21, 2015, https://web.archive.org/web/20061004081944/http://www.archersadvantage.com/AdPages/AAIntro.htm.

Archers Advantage—Windows Software Preview Marks, Oct. 4, 2006, retrieved from Internet Archives May 21, 2015, https://web.archive.org/web/20061004082104/http://www.archersadvantage.com/AdPages/AAPreviewMarks.htm.

Pinwheel Software—Landing Page, Tapes and Charts, and Products pages, Nov. 2, 2006, retrieved from Internet Archives May 21, 2015: https://web.archive.org/web/20061004034251/http://pinwheelsoftware.com/; https://web.archive.org/web/20061102090816/http://www.pinwheelsoftware.com/tac.aspx; https://web.archive.org/web/20061102090757/http://www.pinwheelsoftware.com/products.aspx.

Pinwheel Software—screen shots of operation of trial software, downloaded, Jun. 3, 2015.

The Archery Program—landing page, Oct. 23, 2006, retrieved from Internet Archives May 21, 2015, https://web.archive.org/web/20061023081202/http://www.thearcheryprogram.com/.

Easton Archery, "Easton 2010 Target Catalog", pp. 1, 30-35, 2010, also available on-line http://archery-shop.jp/catalog/2010TargetCatalog.pdf.

Wise, Larry, "Understanding Draw Force Curves" ArrowTrade, pp. 78-83, Nov. 2006.

Firenock, 2013 Catalog, "iBowSight" Front Cover, pp. 13-14, Jan. 2013.

Olssen, Bertil, "Calculating Arrow Speed From Simple Measurements" Archery Focus, pp. 32-35, Jan./Feb. 2012.

U.S. Appl. No. 14/843,012, filed Sep. 2, 2015, Robert V. Donahoe.

* cited by examiner

APPARATUS, SYSTEM AND METHOD FOR ARCHERY SIGHT TAPE SELECTION

RELATED APPLICATIONS

This application claims the benefit under 35 U.S.C. §119 (e) to U.S. Provisional Application Ser. No. 62/107,679, entitled "APPARATUS, SYSTEM AND METHOD FOR ARCHERY SIGHT TAPE SELECTION," filed on Jan. 26, 2015, the disclosure of which is herein incorporated by reference in its entirety.

BACKGROUND OF INVENTION

1. Field of Invention

Embodiments of the invention generally relate to archery equipment. More specifically, embodiments relate to apparatus, system and methods for selecting an archery sight tape.

2. Discussion of Related Art

The field of archery involves the accurate placement of an arrow striking a target some distance from the point of release by the archer. Archery sights are affixed to an archery bow to allow the archer to precisely aim at a distant target. The sight includes at least one sight pin that is adjusted so that the archer can align it with a distant bullseye. The effect of gravity on the arrow's flight acts to draw the arrow back toward the ground as the arrow travels from the archer toward the target. Therefore, as the distance to the target increases, a lower sight pin elevation is employed. This results in the archer raising a point-of-aim of the bow to align the sight pin with the bullseye as the shot-distance increases. Thus, the position of the sight pin allows the archery to accurately establish the launch angle of the arrow so that it will strike the bullseye when loosed from a particular distance.

Archery sights fall into two general categories, fixed pin sights and slider-type sights. Where a slider-type sight is used the sight pin is temporarily locked in place when a shot is taken and the archer adjusts the elevation of the pin when the shot-distance changes. In contrast, fixed pin sights generally include one or more pins whose locations are adjusted in the sighting-in process and then fixed in place to provide a sighted-in pin elevation for a specific distance, respectively. Generally, the pin elevation of fixed pin sights is not further adjusted unless the user goes through the sighting in process again. Depending on the embodiment, a slider-type sight can include only a single pin or multiple sight pins. Similarly, a fixed pin sight can include a single pin or multiple sight pins depending on the embodiment.

A sight-pin is sighted-in when an archer can place the sight pin over the center of the bullseye in their line-of-sight with the bow drawn, loose the arrow with the sight pin so located, and strike the center of the target. Because of the constantly changing elevation of an arrow in flight, the preceding result means that the sight-pin is sighted-in for the single shot-distance at which that particular shot or series of shots are taken.

Generally, slider-type sights employ a sight tape that is affixed to the sight, for example, the sight-housing, and an alignment pin. The sight tape is marked with a series of marks for various shot-distances. The alignment pin provides the archer with a visual indication of the shot-distance that the sight pin is adjusted for. In some sights, the sight tape is stationary and the alignment pin moves with the sight pin as the elevation of the sight is adjusted. In other single pin sights, sight-adjustment moves the sight tape while the alignment pin remains stationary.

Referring to FIG. 1 a prior art slider-type archery sight 100 is illustrated. The archery sight 120 can be employed in accordance with some embodiments described herein. According to the illustrated embodiment, the sight 120 includes a housing 122, a sight pin 124, an arm 126 and a face 127. Further, the housing 122 can include a frame 123 within which the sight pin 124 is located. The face 127 is designed to receive a sight tape 129 which is glued, taped or otherwise attached to the face 127. Further, the sight tape 129 can include indicia 132 to provide a positional reference concerning the adjustment of the sight 120. Depending on the embodiment, the indicia 132 includes lines 130 and numerals 131 for reference. For ease of use, such indicia 132 generally correspond to distances, for example, where the lines 130 represent one yard (or other distance) increments and the numerals 131 are presented at 10 yard intervals. In the illustrated embodiment, the sight 120 also includes a reference pin 134 and a locking mechanism 136.

The locking mechanism 136 includes a thumb-wheel operated set screw, however, other means of releasably securing the position of the sight pin 124 and arm 126 can be used. In some embodiments, the face 127 and the alignment pin 134 are located at the end of a lever or other mechanical structure attached to the housing 122 that places the face 127 and alignment pin 134 closer to the archer than the location of the sight pin 124. According to these embodiments, the ratio of movement of the alignment pin 134 to movement of the sight pin 124 is greater than 1:1.

Approaches for establishing the correct position of the sight pin (for example, the elevation of the sight pin 124 in the housing 122) are described in more detail below. However, in use, adjustment of the position of the sight pin 124 is made by releasing the locking mechanism 136 and moving the adjustable portion of the sight to raise or lower the alignment pin 134 until it is aligned with the desired indicia 132. For example, the archer can adjust the sight so the alignment pin 134 is moved to align with the 40 yard mark when the archer is about to take a 40 yard shot. Provided the bow is already sighted-in, the preceding adjustment places the sight pin 124 in the proper position for a 40 yard shot. The locking mechanism 136 is then re-secured to maintain the sight pin elevation. As referred to in the preceding, the "proper position" refers to a position that allows the archer to align the sight pin 124 with the center of the bullseye 40 yards away to hit the center of the bullseye with an arrow loosed from the bow.

Today, manufacturers often provide a set of sight tapes and a marking tape for a given sight. To begin the sighting-in process, the archer places the marking tape on the sight and takes a shot or series of shots at a first known-distance to sight-in at that distance. In particular, a first known-distance that is marked on the tapes in the set of sight tapes. When the sight pin elevation is properly set for the first known-distance (the bow is sighted-in at the first distance), the archer marks the position of the alignment pin on the marking tape. The archer then takes a shot or series of shots at a second known-distance to sight-in at the second distance. The second known-distance is also a distance that is marked on the sight tapes. When the sight pin elevation is properly set for the second known-distance, the archer marks the position of the alignment pin on the marking tape. The sight tape is selected based on the distance separating the two marks on the marking tape, i.e., the gap between the two marks. Specifically, the archer compares the distance between the marks on the marking tape with the distance between the marks for the same two shot-distances on the tapes included in the set of sight tapes. The sight tape that is used is the sight tape that has a distance separating the marks for the first and second known-distances that most closely matches the distance established by the marking tape. In some approaches, a gauge is used to compare the gap on the marking tape with gaps provided on the various sight tapes in the set.

FIG. 2 illustrates a known process 110 for sight-tape selection. The process 110 requires that that the bow be sighted-in at a first distance and a second distance much farther downrange than the first distance. In particular, at act 112, the bow is sighted in at first distance (for example, 20 or 30 yards). The archer records the position of the sight pin for the first distance at act 113, for example by marking a blank set-up tape mounted on the archery sight. The process is then repeated at acts 114 and 115. For example, at act 114, the bow is sighted in at second distance (generally, 40 or more yards downrange). At act 115, the position of the sight pin for the second distance is recorded. At act 116, the sight tape for use across a range of distance from 20-80 yards downrange is selected from a set of sight tapes based on a difference between the sight pin position for the first distance and the sight pin position for the second distance.

Other manufacturers use a similar approach with a set-up tape that is pre-marked with indicia. A difference in value between a value of the numerical indicia adjacent the alignment pin when sighted-in at the first known-distance and a value of the numerical indicia adjacent to the alignment pin when sighted-in at the second known-distance is used to select the sight tape. In still another approach, the calibration tape includes a series of sight marks each labeled with indicia that associates the individual sight mark with a selected one of the sight tapes included in the set of sight tapes. According to one embodiment, the indicia expressly identifies the sight tape, for example, the indicia includes a unique identifier such as an alpha character, a numeric figure or combined alpha-numeric information. In some embodiments, the setup tape is referred to as a "calibration" tape.

Regardless, these approaches require accurate shooting at the two known distances to establish the correct sight tape. Therefore, the difficulty with such approaches is the amount of time they require to complete and the fact that long distant shots must be used for at least one of the two known-distances. For example, a first shot-distance of 20 yards and a second distance of 50 yards are recommended in one approach while shot-distances of 30 and 60 yards are recommended in another approach. The long shot-distances of 50 and 60 yards are more difficult to sight-in because the group-size of a series of arrows shot at such distances are significantly larger on average than the group-size for shots taken at shorter distances. Therefore, it becomes more difficult for the archer to assess whether they are sighted-in with enough precision at that distance. Longer shot-distances not only make it difficult to accurately sight-in they also require more space than is typically available at indoor range facilities. Therefore, it can be difficult to locate a facility that allows the conventional sight-in procedure. In addition, it is easier to lose arrows outdoors at long shot-distances.

Other archers use software to establish the sight tape that provides sighted-in marks for their archery equipment. Generally, the archer must use the software to generate a custom sight tape and then print the sight tape on a printer. Further, sight tape selection and sight tape printing of sight tapes in which the alignment pin does not move in a 1:1 ratio with the sight pin are not available.

Thus, improvements in the approach for accurately determining the correct sight tape from among a set of sight tapes are necessary.

Commonly-owned U.S. Pat. No. 8,221,273, entitled "APPARATUS, SYSTEM AND METHOD FOR ARCHERY EQUIPMENT," issued on Jul. 17, 2012 (the '273 patent), generally describes a touchpad screen employed in an archery system including embodiments for setting a pin height of an archery sight. U.S. Pat. No. 8,221,273 is herein incorporated by reference in its entirety.

SUMMARY OF INVENTION

Therefore there is a need for apparatus, systems and methods for selecting a sight tape from a set of sight tapes with sight marks already established, for example, a set of pre-printed sight tapes. According to various embodiments, the apparatus, systems and methods described herein can save hours of time for an archer setting up a conventional archery sight. Such approaches can be employed with multi-pin sights, slider-type sights and fixed pin sights that use a sight tape. Approaches herein can deliver precise sight tape selection without an archer taking any shots downrange, except to collect performance data; once a sight tape is selected the archer need only sight in at a single distance to establish a full set of sight marks.

Approaches herein can deliver precise sight tape selection from an already established set of sight tapes without an archer taking any shots except to collect performance data. Then, once a sight tape is selected the archer need only sight in at a single distance to provide a plurality of sight marks sighted-in for a plurality of distances, respectively. In general, the approaches herein generate sight settings, determine the separation of pre-selected ones of the sight settings or the difference in sight pin elevation ("pin gap") for comparison with one or similar measurements stored for the already established sight tapes (pre-built sight tapes). Embodiments described herein are effective in selecting a sight tape even for sights in which the alignment pin moves in other than a 1:1 ratio with the sight pin. According to some embodiments, the use of measured arrow drag and/or time-of-flight reduces the complexity of archery sight tape selection.

Embodiments described herein can eliminate the need to shoot at long distance and the need to use an outdoor range. Eliminating the dependence on long shot distances, therefore, creates an approach that is suited to a wider range of facilities (for example, indoor archery ranges with limited space) and a wider range of archers (i.e., those with a lower skill level who are not comfortable sighting-in at long shot-distances).

Further, in various embodiments, a personal computer and/or printer are not required to select and/or print the sight tape. Accordingly, embodiments described herein allow a user to select the correct sight tape in any setting, for example, in the field, at an indoor archery range or at an outdoor archery range.

The process used to accurately set the sight pin locations in the archery sight is referred to as "sighting-in" the bow. An accurately adjusted sight has the elevation of the sight pin(s) properly established for use when shooting at one or more distances and is referred to as being "sighted-in." Further, in a multi-pin sight, the pin setting for a given distance is "sighted-in" when the position of that individual pin is established to allow the archer to consistently hit the bullseye at the given distance by aligning the pin with the bullseye when the arrow is loosed from the bow.

Embodiments can greatly increase the certainty provided by a set of archery sight marks while greatly reducing the number of arrows that must be shot to arrive at a plurality of sight marks that are accurately sighted-in. According to further embodiments, only a single sight mark need be manually sighted-in by shooting the bow and arrow. The single sight mark can then serve as a reference for a full set of sight marks generated by the portable electronic device.

As used herein, a "sight mark" is a reference used to establish an elevation of a sight pin where the sight pin is employed by an archer to aim an archery bow when releasing an arrow from the bow. The "sight mark" can be provided in an electronic display medium (for example, as rendered in a graphical user interface), in printed form or other formats such as stamped, painted, engraved, or etched in a sight housing. Those of skill in the art will recognize that a "sight mark" can be provided in a variety of forms including solid geometric shapes, outlined geometric shapes, cross hairs and hash marks to name a few examples.

As used herein, a "sight setting" refers to a location (for example, an elevation) of a sight pin for a known shot-distance and given archery parameters. In general, a plurality of sight settings are generated to allow the sight settings for various shot distances to be referenced relative to one another for the given archery parameters. Thus, sight settings can be used to provide locations of the sight pin (or sight pins) for the known shot-distance relative to the location of the sight pin (or other sight pins) for at least one other known shot-distance, for example, referenced based on a distance separating the two sight settings. If the distances separating the sight settings are maintained when applied to the sight itself (for example, via corresponding sight marks applied to a sight tape), the user need only sight-in at one of the sight settings and the reminder of the sight settings establish sighted in positions for the other known shot-distances included in the sight settings. As a result, once a sight pin is located in a sighted-in position for a first sight setting, the pin or other pins can be moved to any one of the other sight settings and the archery equipment will be sighted in at the respective shot-distance that corresponds to the sight setting.

In various embodiments described herein, sight settings for selected archery equipment are mathematically determined based on archery parameters provided for the equipment. Further, in some embodiments the sight settings are employed for sight tape selection and are not displayed to the user. In other embodiments, the sight settings are displayed or printed as a set of sight marks.

As used herein, an "archery parameter" refers to information that can be used either alone or in combination with one or more other pieces of information to determine an arrow's expected flight. Those of skill in the art will recognize that an "archery parameter" can include: archery equipment identification information (for example, equipment manufacturer, a type of bow, type of arrow, and/or type of vanes); archery equipment setting information (for example, draw length, draw weight, peep-to-sight dimensions and/or peep-to-arrow dimensions); and archery equipment performance information (for example, rated bow speed, arrow launch speed, arrow drag) as some non-limiting examples.

Applicant has recognized and appreciated that modern sensing technology provides new opportunities to collect arrow flight-data that can be used to more accurately estimate an arrow's trajectory over a range of distance. One such flight data recording system concerns microelectronic sensing systems included in arrows to measure flight characteristics. Some of these microelectronic systems precisely measure time-of-flight and arrow drag. Such approaches are described, for example, in the following applications owned by the applicant of this application: U.S. patent application Ser. No. 12/982,456, entitled "Apparatus, System and Method for Electronic Archery Devices," filed Dec. 30, 2010; U.S. Pat. No. 8,221,273, entitled "Apparatus, System and Method for Archery Equipment," issued Jul. 17, 2012; and U.S. Pat. No. 7,972,230, entitled "System and Apparatus for Archery Equipment," issued Jul. 5, 2011. Each of the preceding patents or patent applications is herein incorporated by reference in its entirety.

According to one aspect, a non-transitory computer-readable medium is provided whose contents cause a processing device including a processor, a memory coupled to the processor and a display coupled to the processor to perform a method of selecting an archery sight tape for an archery sight employed with selected archery equipment, the archery sight tape included in a plurality of sight tapes uniquely identified relative to one another. According to some embodiments, the method includes: storing in the memory, for each of the plurality of sight tapes, a first distance separating two sight marks included on each of the plurality of sight tapes, respectively, the two sight marks including a first sight mark associated with a first known shot-distance and a second sight mark associated with a second known shot-distance, wherein each of the respective first known shot-distances are selected to be the same as one another, and wherein each of the respective second known shot-distances are selected to be the same as one another; providing at least one archery parameter for the selected archery equipment; determining, by the processor, sight settings for the selected archery equipment based, at least in part, on the at least one archery parameter; determining, by the processor, a second distance from the sight settings, the second distance separating a first sight setting associated with the first known shot-distance and a second sight setting associated with the second known shot-distance; comparing, by the processor, a value of the second distance with a value of the respective first distances to determine which of the respective first distances most closely matches the second distance; and providing an identification of an archery sight tape included in the plurality of archery sight tapes having the first distance that most closely matches the second distance.

According to one embodiment, the archery sight includes at least one mechanically operated sight pin. According to another embodiment, the act of providing the identification includes an act of providing an indicia that uniquely identifies the archery sight tape. According to a further embodiment, the indicia includes a numeric indicia. According to a still further embodiment, the indicia includes an alpha indicia.

According to other embodiments, a non-transitory computer-readable medium is provided whose contents cause a processing device including a processor, a memory coupled to the processor and a display coupled to the processor to perform a method of selecting an archery sight tape for an archery sight employed with selected archery equipment, the archery sight including a sight pin, the archery sight tape included in a plurality of sight tapes and a setup tape. According to some embodiments, the method includes: storing in the memory, for each of the plurality of sight tapes, a first distance between a first position of the sight pin established for a first known shot-distance and a second position of the sight pin established for a second known shot-distance, respectively, wherein the setup tape includes a first sight mark common to each of the plurality of sight tapes for use at the first known shot-distance, and wherein the setup tape includes a plurality of second sight marks for use at the second known shot-distance, each of the plurality of second sight marks including an indicia that uniquely identifies one of the plurality of sight tapes, respectively; providing at least one archery parameter for the selected archery equipment; determining, by the processor, sight settings for the selected archery equipment based, at least in part, on the at least one archery parameter; determining, by the processor, a second distance from the sight settings, the second distance separating a first sight setting associated with the first known shot-distance and a second sight setting associated with the second known shot-distance; comparing, by the processor, a value of the second distance with a value of the respective first distances to determine which of the respective first distances most closely matches the second distance; and providing an identification of an archery sight tape included in the plurality of archery sight tapes having the first distance that most closely matches the second distance.

According to one embodiment, the archery sight includes at least one mechanically operated sight pin. According to a further embodiment, the first distance represents a difference in a pin elevation in the archery sight and the second distance represents the difference in the pin elevation in the archery sight.

According to still another embodiment, a non-transitory computer-readable medium is provided whose contents cause a processing device including a processor, a memory coupled to the processor and a display coupled to the processor to perform a method of selecting an archery sight tape for an archery sight employed with selected archery equipment, the archery sight including a sight pin, the archery sight tape included in a plurality of sight tapes and a setup tape. According to some embodiments, the method includes: storing in the memory, for each of the plurality of sight tapes, a first distance between a first position of the sight pin established for a first known shot-distance and a second position of the sight pin established for a second known shot-distance, respectively, wherein the setup tape provides data employed to determine a numerical value corresponding to each of the first differences, respectively, and wherein each of the respective numerical values uniquely identifies a respective one of the plurality of sight tapes; providing at least one archery parameter for the selected archery equipment; determining, by the processor, sight settings for the selected archery equipment based, at least in part, on the at least one archery parameter; determining, by the processor, a second distance from the sight settings, the second distance separating a first sight setting associated with the first known shot-distance and a second sight setting associated with the second known shot-distance; comparing, by the processor, a value of the second distance with a value of the respective first distances to determine which of the respective first distances most closely matches the second distance; and providing an identification of an archery sight tape included in the plurality of archery sight tapes having the first distance that most closely matches the second distance.

According to another aspect, an apparatus includes a display, one or more processors coupled to the display; and a computer storage medium storing instructions that, when executed by the one or more processors, cause the one or more processors to perform operations that select an archery sight tape for an archery sight employed with selected archery equipment, the archery sight tape included in a plurality of sight tapes uniquely identified relative to one another. According to one embodiment, the operations include: rendering a graphical user interface in the display; receiving a first input to the graphical user interface to select at least one archery parameter; and determining, by the processor, sight settings for the selected archery equipment based, at least in part, on the at least one archery parameter; determining, by the processor, a first distance from the sight settings, the first distance separating a first sight setting associated with a first known shot-distance and a second sight setting associated with a second known shot-distance; comparing, by the processor, a value of the first distance with a value of respective second distances to determine which of the respective second distances most closely matches the first distance, wherein the respective second distances are stored in the memory for each of the plurality of sight tapes, wherein the second distances separate two sight marks included on each of the plurality of sight tapes, respectively, the two sight marks including a first sight mark associated with the first known shot-distance and a second sight mark associated with the second known shot-distance, wherein each of the respective first known shot-distances are selected to be the same as one another, and wherein each of the respective second known shot-distances are selected to be the same as one another; and displaying an identification of an archery sight tape included in the plurality of archery sight tapes having the second distance that most closely matches the first distance.

According to still another aspect, a system for identifying a sight tape included in a plurality of sight tapes for use with selected archery equipment including an archery sight is provided. According to some embodiments, the system includes at least one processor; a memory coupled to the at least one processor, the memory configured to store for each of the plurality of sight tapes, a first distance separating two sight marks included on each of the plurality of sight tapes, respectively, the two sight marks including a first sight mark associated with a first known shot-distance and a second sight mark associated with a second known shot-distance, wherein each of the respective first known shot-distances are selected to be the same as one another, and wherein each of the respective second known shot-distances are selected to be the same as one another; a sight setting module included in the at least one processor and configured to determine sight settings for the selected archery equipment based, at least in part, on at least one archery parameter provided for the selected archery equipment, the sight setting module also configured to determine the second distance from the sight settings, the second distance separating a first sight setting associated with the first known shot-distance and a second sight setting associated with the second known shot-distance; and a comparison module included in the at least one processor and configured to compare a value of the second distance with a value of the respective first distances to determine which of the respective first distances most closely matches the second distance, the comparison module also configured to identify an archery sight tape included in the plurality of archery sight tapes having the first distance that most closely matches the second distance.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
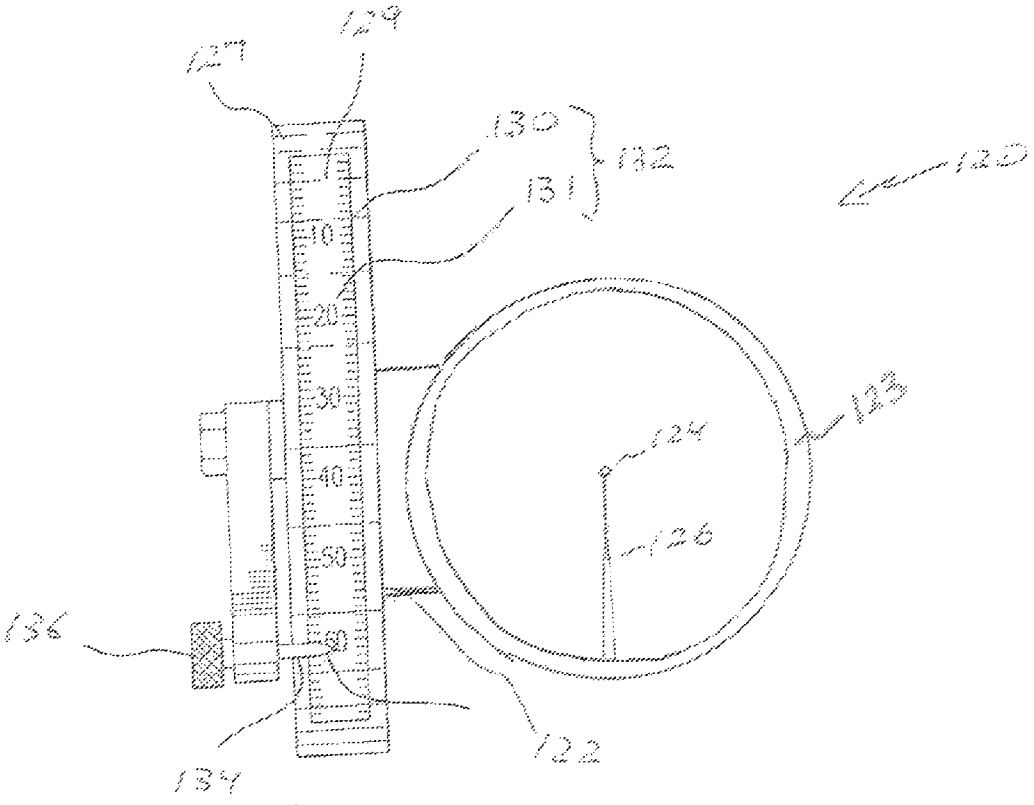
FIG. 1 PRIOR ART
FIG. 1 illustrates a sight-tape selection process of the prior art.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

Figure 3:
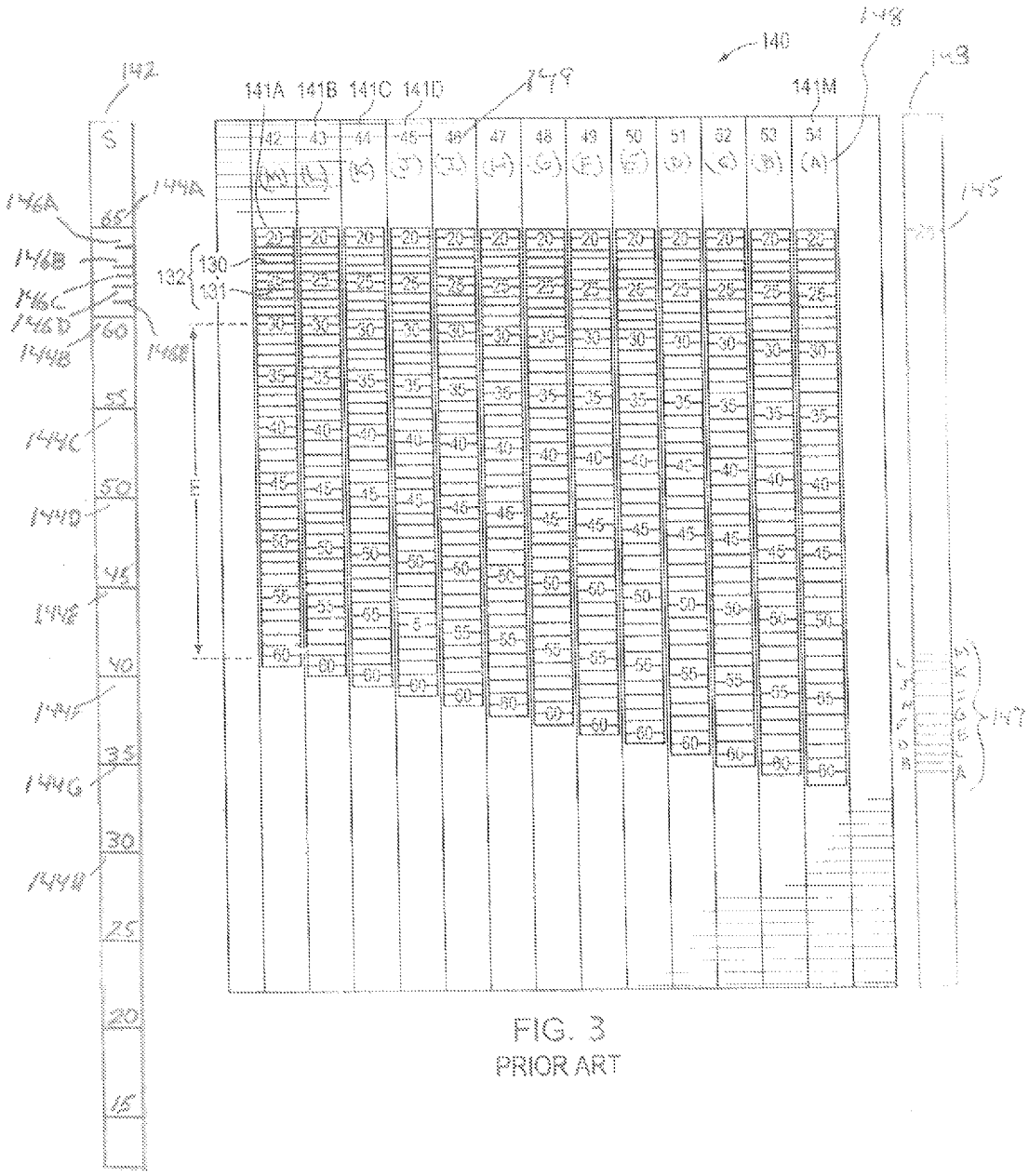
FIG. 3 PRIOR ART
FIG. 3 illustrates a set of sight tapes for a single pin archery sight in accordance with some embodiments.

Referring now to FIG. 3, a set 140 of sight tapes is illustrated where the set includes a plurality of sight tapes 141 for use with the archery sight 120. The set 140 can be employed in accordance with some embodiments described herein. In the illustrated embodiment, the set includes a total of 13 separate sight tapes beginning with the rightmost sight tape 141A, then sight tape 141B, sight tape 141C, sight tape 141D and, continuing to move to the far right the $13^{th}$ sight tape 141M. According to one embodiment, the set of sight tapes 140 are adhesive backed to allow a peel and stick removal from the set and attachment to the sight, for example, the face 127 of the sight 120. Further, each of the plurality of sight tapes 141 includes indicia 132 including lines 130 and numerals 131. In general, the indicia 132 are more closely grouped together for the faster shooting bow/arrow combinations.

In one embodiment, each of the plurality of sight tapes 141 includes an identification numeral 149 that uniquely identifies the sight tape (for example, sight tape 141A and identification number "42") relative to other sight tapes included in the set 140. In other embodiments, an identification letter 148 (for example, sight tape 141E and identification letter "(I)") is employed to uniquely identify one sight tape from another. Combinations of numerals and letters can be employed as well as various symbols depending on the embodiment.

Referring again to FIG. 3, the set 140 includes the sight tape 141A with the indicia 132 located most closely together and the sight tape 141M with the indicia 132 located furthest apart. In FIG. 3, the distance E is a distance that separates two known distances on a sight tape, for example, the distance between the 30 yard indicia and the 60 yard indicia on the sight tape 141A. The distance E, between 30 and 60 yard indicia is smallest on the sight tape 141A and largest on the sight tape 141M. As is described below, the distance E or another distance between known indicia that appear on each of the sight tapes 141 in the set 140 can be used as a reference pair of indicia to select a sight tape for a given bow/arrow combination. For example, in another embodiment, a distance between the 20 yard indicia and the 50 yard indicia can be used.

Some archery sight systems include a setup tape in addition to the set of actual sight tapes where the set-up tape is pre-marked with indicia. Often such systems are employed with an archery sight that includes a curved surface (for example, the face of an adjustment wheel) on which the sight tape is located. According to these embodiments, the setup tape is first secured in place of the sight tape. The archery equipment is sighted in at two distances. The sight tape selection is made using information provided by the setup tape when the equipment is sighted in at the two distances.

Accordingly, FIG. 3 illustrates a first setup tape 142 and a second setup tape 143 where the first setup tape 142 is employed in a first process and the second setup tape is employed in a second process. Although multiple types of setup tapes can be included with the plurality of sight tapes 141, generally where a setup tape is included only a single type of setup tape is provided. For example, a first bow sight manufacturer may use the first setup-tape style and a second bow sight manufacturer may use the second setup-tape style.

In the illustrated embodiment, the first setup tape 142 includes numerically labeled indicia, for example, 144A-144H and other indicia, for example, 146A-146H. In some embodiments, the other indicia 146A-146H can also include a numerical label, an alpha label, alpha-numeric label and/or symbols.

In the illustrated embodiment, the second setup tape 143 includes a first sight mark 145 and a plurality of second sight marks 147, for example, the sight marks labeled with indicia A-M, respectively. The indicia A-M are illustrated on either side of the second setup tape 143 for clarity. In practice, however, the indicia A-M are included (for example, printed) on the setup tape 143.

For purposes of illustrating apparatus, systems and methods for computer-based sight tape selection, separate embodiments are described herein. These include at least a first embodiment in which a gap between selected sight marks (for example, sight marks for the known shot-distances of 20 and 60 yards) is stored for each sight tape 141 included in a plurality of sight tapes 141, where a gap between sight settings determined for selected archery equipment is compared with the gaps on the plurality of sight tapes to find a closest match. This embodiment can be used with archery sights in which the vertical travel of the sight pin and the alignment pin is a 1:1 ratio.

A second embodiment is employed with archery sight tapes established for archery sights in which the travel of the sight pin and travel of the alignment pin is other than on a 1:1 ratio. For example, where the mechanical adjustment of the archery sight includes wheels, levers or dials the alignment pin can travel at greater than a 1:1 ratio relative to the travel of the sight pin. Often the sight tape is applied on a curved surface such as an arc, dial or wheel for these style sights. According to these embodiments, a sight-pin gap (for example, a difference in sight-pin height between the sight-pin positions for the known shot-distances of 20 and 60 yards, respectively) is stored for each of the sight tapes included in the plurality of sight tapes along with the indicia of the sight tape corresponding to the respective sight-gap. According to some embodiments, the preceding is established by moving the alignment pin between a first position on a setup tape and a second position on a setup tape and recording the resulting sight pin gap. The first position corresponds to a first shot distance and the second position corresponds to a second shot distance.

According to this second embodiment, a gap between sight-pin settings determined for selected archery equipment is compared with the difference in sight-pin gap for each of the plurality of sight tapes to find a closest match. In one further embodiment relative to the second embodiment, the setup tape 143 is employed and includes the first sight mark 145 and the plurality of second sight marks 147. In another further embodiment relative to the second embodiment, the setup tape 142 includes numerical values employed to determine the numerical indicia that identifies the sight tape that provides the closest matching pin gap relative to the sight settings determined for the selected archery equipment.

Referring again to FIG. 3, the set 140 includes the sight tape 141A with the indicia 132 located most closely together and the sight tape 141M with the indicia 132 located furthest apart. In FIG. 3, the distance E is a distance that separates two known distances on a sight tape, for example, the distance between the 30 yard indicia and the 60 yard indicia on the sight tape 141A. The distance E, between 30 and 60 yard indicia is smallest on the sight tape 141A and largest on the sight tape 141M. As is described below, the distance E or another distance between known indicia that appear on each of the sight tapes 141 in the set 140 can be used as a reference pair of indicia to select a sight tape for a given bow/arrow combination. For example, in another embodiment, a distance between the 20 yard indicia and the 50 yard indicia can be used.

According to an embodiment employing the first setup tape 142 a difference in value between a value of the numerical indicia adjacent the alignment pin when sighted-in at the first known-distance and a value of the numerical indicia adjacent to the alignment pin when sighted-in at the second known-distance is used to select the sight tape. According to this embodiment, the difference in value provides a numerical value that can be matched to one of the indicia 148.

Figure 4:
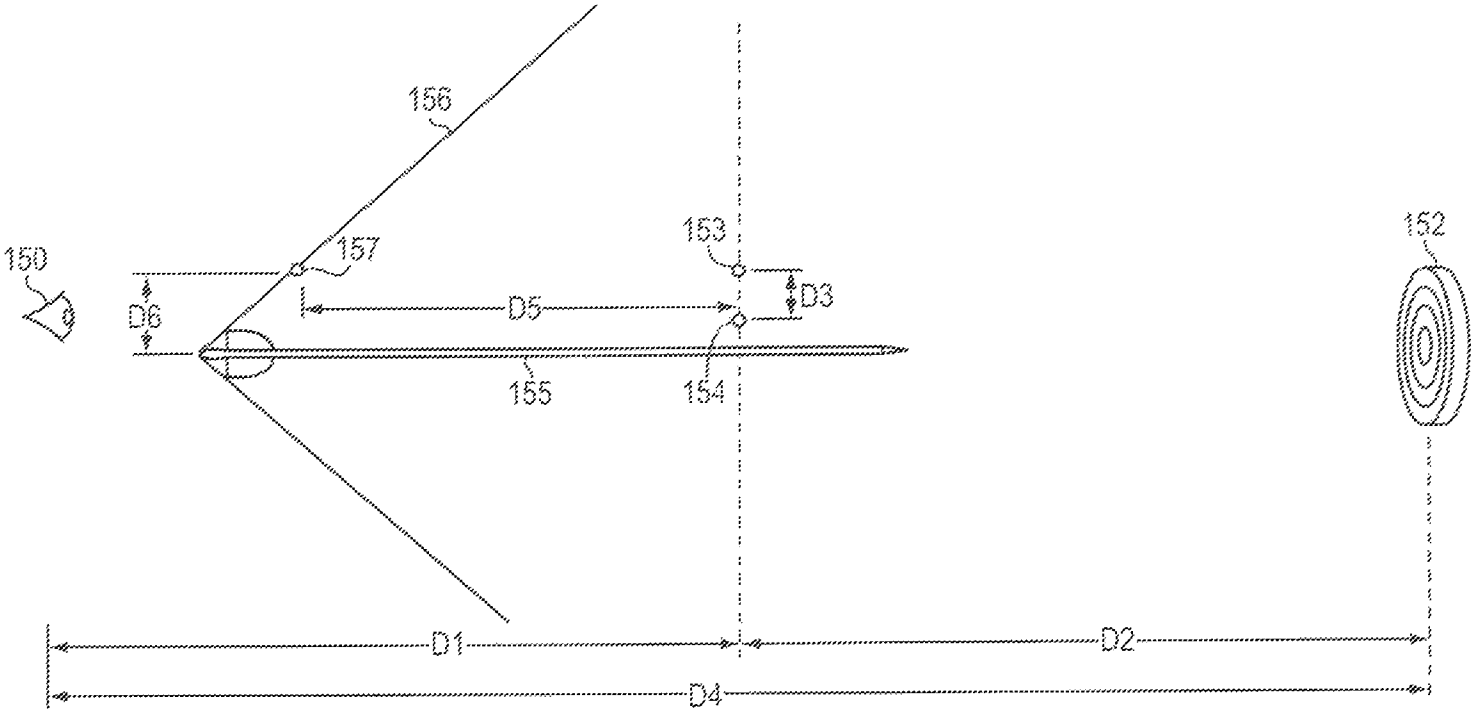
FIG. 4 illustrates a set of reference points for an archery sighting-in process in accordance with one embodiment.

FIG. 4 of provides a simplified diagram to illustrate the relationship between some of the reference points used in setting an archery sight. For clarity, the bow and the sight housing are not illustrated. In FIG. 4, an eye 150 of an archer is presented relative to an archery target 152, a first sight pin position 153, a second sight pin position 154 and an arrow 155. Further, the bow includes a peep sight 157 located on a string 156 of the bow. An arrow 158 knocked on the bow with the bow at a full draw position is included for reference. According to various embodiments, one or more sight pins are included in an archery sight attached to a riser of the bow. Where a fixed pin sight is employed the first and second sight pin positions 153, 154 can be established with two different sight pins. Where a slider-type sight is employed the first sight pin position 153 and the second sight pin position 154 can be established by adjusting a position, for example, an elevation, of a single pin included in the sight.

Referring to FIG. 4, the distance D1 approximately corresponds to a draw length of the archer, the distance D2 approximately corresponds to a shot-distance (i.e., a distance from where the archer stands to the target 152), and the distance D4 is the distance from the archers eye, when taking aim with the bow mounted archery sight, to the target 152. Often, the peep sight 157 provides an additional reference (an aid in properly aligning the archers eye 150, the archery sight and the target 152) or other aid is located between the archer's eye 150 and the sight pins of the sight. In the illustrated embodiment, the distance D5 is the distance between the peep sight 157 and the archery sight where the sight pin positions 153, 154 are located. The distance D6 is the distance between the peep sight 157 and the arrow The distance D3 is the distance (for example, a difference in elevation) that separates the first sight pin position 153 and the second sight pin position 154 from one another. Various embodiments described herein determine the distance D3 between sight pin positions, for example, the distance between a pin for which the archer has sighted in the bow (either the first sight pin position 153 and the second sight pin position 154) to one or more different sight pin positions. The distance D3 can also be referred to as a "pin gap."

Some embodiments described herein provide an approach to establish accurate sight marks for sight pin elevation/position via selection of the proper sight tape and to do so without taking any shots other than those needed to provide the arrow speed when it leaves the bow. Once the sight tape is properly selected it can be placed accurately on the bow sight when the user sights-in at only a single distance. When accurately located on the bow sight, the sight marks that the sight tape provides can be used to shoot accurately across the range of distances covered by the sight tape. Thus, the accurate sight tape can be selected before the sighting-in process begins. In addition, the approaches described herein simplify the sighting-in process by reducing it to acts of: 1) sighting in at a single shot distance; and 2) locating the sight tape on the sight based on the sight mark determined for that single shot distance.

Figure 2:
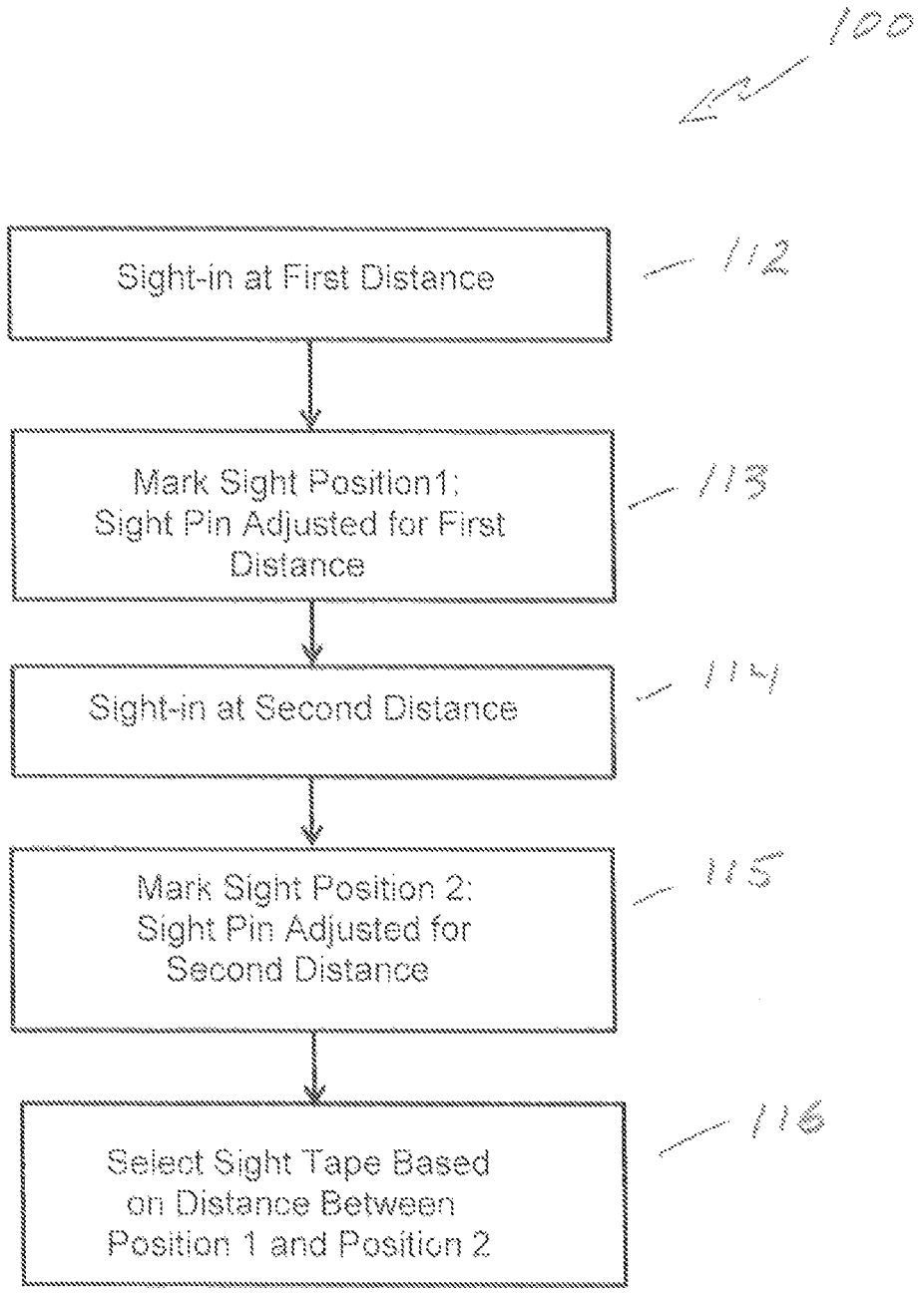
FIG. 2 Prior Art
FIG. 2 illustrates a single-pin archery sight of the prior art.

According to some embodiments, the single shot distance is less than 40 yards. In one embodiment, the single distance is 20 yards because 20 yards is almost universally available at indoor archery ranges. In some embodiments, arrow drag is employed to facilitate each of the preceding embodiments. Further, in some embodiments, the arrow drag is directly measured using a sensing system included in the arrow when shot from the bow. In other embodiments, arrow drag is estimated, for example, based on the arrow speed, vane/fletching type and/or arrow shaft selection for the archery equipment for which the sight marks are being established. In still other embodiments, sight marks are established without the use of arrow drag. Each of these approaches is in contrast to prior approaches in which a sight tape cannot be selected without sighting in at a minimum of two distances, for example, as illustrated in FIG. 2.

Further, embodiments of an archery sight tape selection application as described herein can provide multiple approaches for establishing the correct sight tape from a plurality of sight tapes based on different combinations of archery parameters, respectively. For example, in one embodiment, the archery parameters include archery equipment setting parameters (for example, peep-to-sight and peep-to-arrow measurements) and archery equipment performance parameters (for example, arrow launch speed). According to these embodiments, a plurality of sight marks are generated with the preceding information. In a further embodiment, improved precision is achieved by also including arrow drag in the archery performance parameters used to generate the plurality of sight marks. According to one embodiment, a measured arrow drag is employed. According to another embodiment, arrow drag is calculated based on information concerning arrow launch speed and/or arrow construction (for example, a shaft type, a type of vane/fletching, a shaft diameter and combinations of any of the preceding and other information).

In an alternative embodiment, the sight tape selection is accomplished based solely on archery equipment selection parameters (for example, make and model of the bow and arrow, draw weight and draw length) and a limited amount of equipment setting information (for example, the peep-to-arrow and peep-to-sight measurements). While this embodiment may not provide the degree of precision as the approaches described in the immediately preceding paragraphs, it can still deliver a satisfactory result in many situations. In still another embodiment, the sight tape selection is generated with the archery equipment selection parameters but without use of measured dimensions of the peep sight. Instead, the equipment setting information may either not be used or be estimated from the archery equipment selection parameters.

Figure 5:
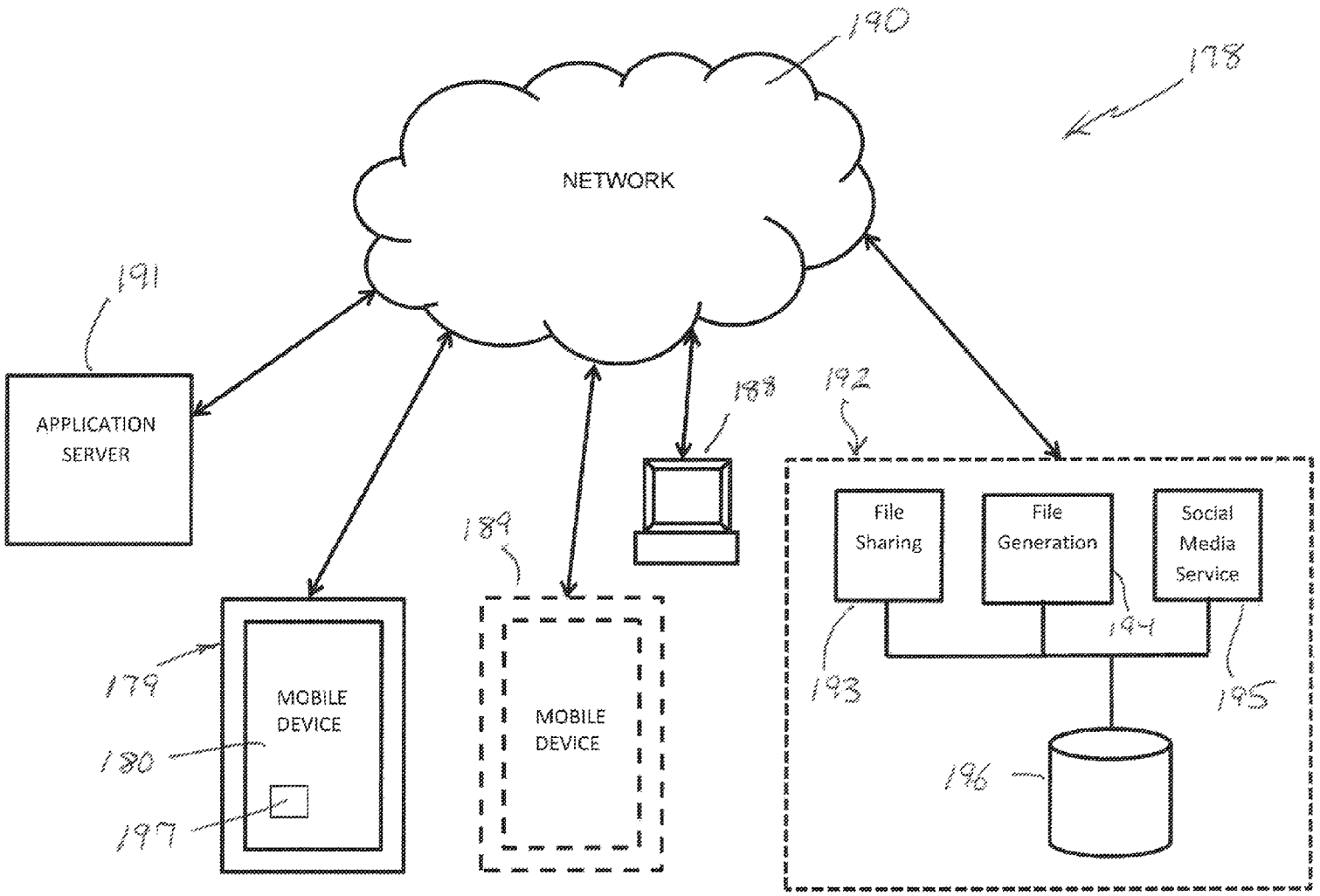
FIG. 5 illustrates a system including a network operating environment for a device in accordance with one embodiment.

Referring to FIG. 5, a system 178 including a network operating environment for a device 179 that can be used for a computer-based selection of an archery sight tape is illustrated in accordance with various embodiments. In accordance with the illustrated embodiment, the system includes the mobile device 179, a stationary device 188, additional user devices 189, a network 190, an application server 191 and services 192, for example, services and/or resources remotely accessible by the devices 187, 188, 189 for use in selecting an archery sight tape. In the illustrated embodiment, the services 192 include file sharing resources 193, file generation services 194, social media service 195 and one or more databases 196. The services 192 and resources are described in more detail herein. As should be apparent to one of ordinary skill in the art in view of the disclosure provided herein, the services 192 can include other services and/or resources and combinations of services and/or resources depending upon the embodiment.

In general, the network 190 can include either or both of local-area networks (LANs), wide area networks (WANs), wireless communication, wired communication and may include the Internet. According to a further embodiment, the network 190 provides access "over-the-cloud" to one or more remote devices, servers, application resource management and/or data storage systems. For example, the network 190 can allow communication between any of the mobile device 179, the stationary device 188, and the other user devices 189 with one another and/or with any of the other resources and devices coupled to the network 190. Communication can occur using any of Wi-Fi networks, Bluetooth™ communication, cellular networks, satellite communication, and peer-to-peer networks available either alone or in combination with one another via the network 190. Other communication protocols and topologies can also be implemented in accordance with various embodiments. According to some embodiments, a plurality of the end user devices 179, 189, for example, mobile computing devices, and stationary devices 188 suitable for selecting an archery sight tape communicate with and/or access the application server 191 and services 192 via the network 190.

According to various embodiments, the mobile device 179 and the other user devices 189 can be, for example any of a portable device such as a tablet computer, a hand-held computer, a personal digital assistant, a cellular telephone, a camera, a smart phone, and enhance general packet radio service (EGPRS) mobile phone, a media player, a navigation device, an e-mail device, a game console, a laptop computer, or a combination of any two or more of these processing devices and/or other processing devices. In one embodiment, the stationary device 188 is a desktop computer or other device having limited or no mobility but suitable for creating archery sight-settings for viewing, sharing and/or printing.

As is described in more detail with reference to FIG. 7, the device 179 can include a general purpose processor (CPU), a graphics processing unit (GPU), a memory, a display 180 (for example, a touchscreen) and additional processing devices, for example, a compression/decompression module and/or a communication module. The device 179 may have a plurality of input/output interfaces and devices such as a mouse, a joystick, a touchscreen, a keyboard etc. Further, the device 179 may include any one or any combination of peripheral devices, for example, a positioning system, an RF transceiver, a motion sensor, a light sensor, a proximity sensor, one or more additional sensors, a camera, communications hardware and an audio including the speaker and/or annunciators.

Referring to FIG. 5, in various embodiments, the devices 179, 188 and 189 can communicate with one or more services and/or resources via the network 190. In some embodiments, the services can include tools and resources that facilitate the generation of archery sight-settings and selection of sight tapes.

In some embodiments, the display 180 is configured to present a user interface to a user of the device 179, for example, a graphical user interface (GUI). The display 180 can include OLED technology, LCD technology, light emitting polymer display technology or other display technology suitable for presenting information to a user in a visual format. According to some embodiments, the display 180 is touch screen display. According to these embodiments, the display 180 is sensitive/responsive to input selections made by the user contacting the face of the display 180. According to one embodiment, the display 180 includes haptic display technology. According to some embodiments, the display 180 is sensitive to touch inputs received in proximity to, but not actually in contact with the display 180. In accordance with further embodiments, the device 179 can also include one or more additional touch-sensitive surfaces such as a trackpad or touchpad. In various embodiments, the device 179 can also include additional I/O devices such as push-buttons and/or switches that are operable by the user.

According to some embodiments, the display 180 is responsive to multiple touch inputs applied simultaneously to the display by the user. According to these embodiments, the device processes the multiple inputs based on any of the pressure, degree, and/or position of each point of the inputs. Further, the device can process touch input based on the length of a stroke and/or swipe. These embodiments can allow for a wider range of touch inputs to be employed by the user. According to other embodiments, the device 179 can include a display in which contact is made using a stylus or other pointing device.

In general, the device 179 can display one or more graphical user interfaces on the display 180 to provide the user access to various system objects (for example, a display object 197) and for conveying information to the user. In the illustrated embodiment, the display object 197 is a graphic representation of objects employed in a system used to generate archery sight-settings and employ the sight settings to select an archery sight tape. A non-exhaustive list of examples of such system objects include device functions such tools for: selecting one or more archery parameters that affect arrow flight; parameters concerning archery sights or other archery equipment (for example, where an archery parameter can include values represented as discrete values, charts, plots, graphs, etc.); generating, applying and modifying sight settings; creating, displaying, sharing and/or printing files (for example, image, text or data files that identify the selected sight tape); alerts, events or other visual references represented graphically. Accordingly, one or a plurality of icons can be rendered for viewing and/or selection in the display 180 via either a touch input or other input such as a cursor rendered in the display.

Referring to FIG. 5, the system 178 provides tools and functionality accessed by the mobile devices 179, stationary devices 188 and other user devices 189 to allow users of the devices to generate archery sight settings, select the correct sight tape based on the sight settings and stored values concerning a plurality of sight tapes, and/or to share results of the preceding. According to some embodiments, the user employs the mobile device 179, stationary device 188 or other user devices 189 to access and/or download one or more tools from the services 192 to the respective device (179, 188, 189) where the tools are employed to create, edit and/or share the archery sight-settings and sight tape selection.

According to some embodiments, the tools are provided in an application that the user downloads to the device. For example, the application can be downloaded from the application server 191. According to some embodiments, the application server 191 is hosted by a third party service, for example, in an application store or other digital application distribution platform from which other applications unrelated to the archery sight-setting application can also be accessed and downloaded (well-known current examples include the iOS App Store operated by Apple, the Amazon App store and Google Play). According to other embodiments the application server 191 is provided by the entity that hosts the services and resources included in the services 192. Accordingly, in some embodiments the application server 191 is integrated into the services 192. In further embodiments, the system 178 allows updates to the archery sight-tape selection application and other software to be "pushed" to any of the devices 179, 188 and 189 from either or both of the application server 191 and the services 192.

According to the illustrated embodiment, the user further employs the device to access additional resources to share archery sight-settings and sight tape selections with other users of the service 192, for example, via social media resources included in the services 192 or provided by a third-party. For example, the social media service 195 can allow for the sharing of archery sight-settings via Facebook, Twitter, Instagram, the provider of the host application and services 192 and/or other social networks. In a further embodiment, the services 192 and social media service 195 allow the archery sight-settings to be shared via a blog, for example, Tumblr.

Referring to FIG. 5, the file sharing resources 193 generate a different file type with which to share depending on the manner and/or type of device (180, 188, 189) on which the archery sight-setting and/or sight tape selection will be shared in accordance with embodiments. In one example the archery sight-setting is stored in a format compatible with a variety display resolutions, for example, to maintain the scale of the sight setting when shared across a variety of types of mobile devices. According to one embodiment, the archery tape selection provides a version of the selected sight tape scaled to provide a 1:1 ratio of distance as measured between sight marks when the selected virtual sight tape is displayed in the mobile device and distance as measured between sight marks of the archery sight tape for which the sight settings are generated, where the selected virtual sight tape is a graphically rendered version of a selected one of the plurality of sight tapes 140. According to these embodiments, the file sharing resources generate a file for the end-user device on which the sight tape is to be displayed such that the sight marks are rendered to provide the 1:1 ratio (for example, without use of a zoom operation).

According to various embodiments, the file generation service 194 provides users with the resources, for example, applications that can be downloaded to the devices 179, 188, 189. In some embodiments, the applications provide the tools and functionality that allow the user to generate a sight setting tool, display the indicia that uniquely identifies the selected sight tape, and/or selection, and deliver sight-marks in the display using the mobile device 179, stationary device 188 and other user devices 189.

According to some embodiments, the one or more databases 196 store user identification information (for example, user IDs and passwords), user content (for example, sight-settings that are saved at the services 192), other information associated with the user such as their social network/contacts and/or other preferences. Depending on the embodiment, the database 196 can include any of a relational database, object-oriented database, unstructured database, or other database. Further, the database 196 can be included in any aspect of a memory system, such as in RAM, ROM or disc, and may also be separately stored on one or more dedicated data servers included in the services 192.

In various embodiments, the mobile device 179 and the stationary device 188 can implement one or more of a variety of operations associated with the generation and/or sharing of archery sight tape selections and sight settings. According to some embodiments, the devices 179, 188, 189 can present a graphical user interfaces in a display, for example, in the display 180. According to these embodiments, the device responds to inputs received from a user, for example, through the touch-sensitive display and/or a voice activated display. For example, a user can select various operations by launching one or more applications on the device by selecting one of the display objects presented in the display 180. According to alternate embodiments, the user can select operations in other ways including, for example, using one of user-selectable menus included in the user interface. Once an application has been selected, one or more windows or pages corresponding to the application can be displayed on the display 180 of the mobile device 179 or the stationary device 188, for example, via a graphical user interface presented in the display. In embodiments where a touch display is employed, the user can navigate through the windows or pages by selecting appropriate places on the display 180. In other embodiments, the user can navigate through the windows or pages using a cursor rendered in the graphical user interface, for example, the cursor can be positioned using a mouse, touchpad or other input device. In further embodiments, the application can be accessed and navigated to generate, view, modify and/or share archery sight setting voice commands where the device 179, 188, 189 includes a speech recognition system.

Figure 6:
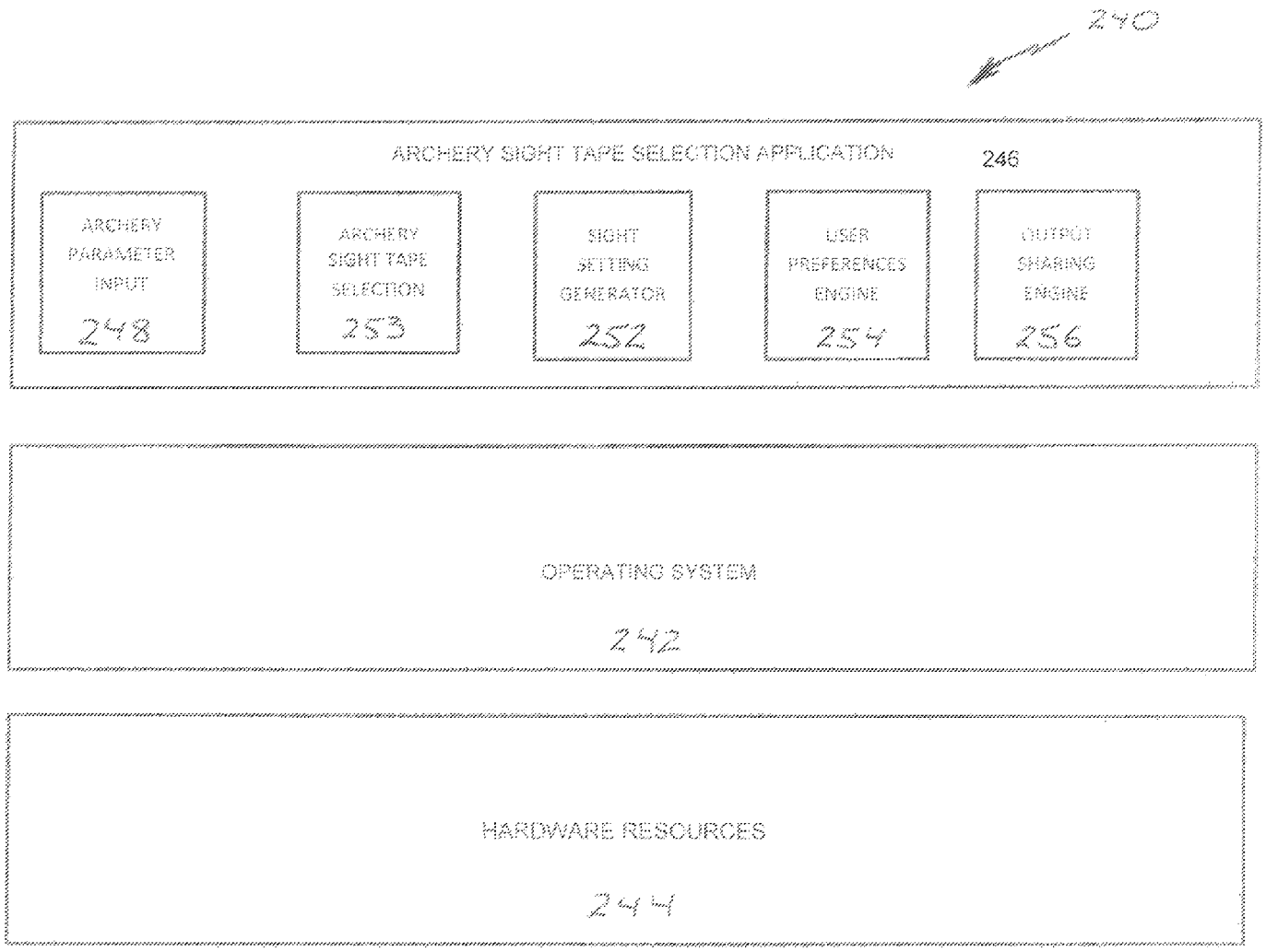
FIG. 6 illustrates a hierarchy for a device in accordance with one embodiment.

FIG. 6 illustrates a hierarchy 240 for generating archery sight-settings and selecting sight tapes and sharing sight tape selections in accordance with various embodiments. In the illustrated embodiment, the hierarchy 240 includes an operating system 242, hardware resources 244 and an archery sight tape selection application 246. In general, the archery sight tape selection application 246 is implemented in accordance with an application programming interface (API) to communicate via the operating system to the various hardware resources and user interfaces available with the device 179. According to various embodiments, the APIs can be a set of APIs that are usually included with operating systems (for example, Linux or UNIX APIs), as well as APIs specific for sending and receiving data via I/O devices such as the display in which a GUI is presented to the user for use in creating sight settings and generating and sharing archery sight tape selections.

As will be apparent to one of ordinary skill in the art in view of the disclosure herein, the archery sight tape selection application 246 can be configured for operation with a variety of operating systems 242 and associated hardware resources 244. For example, the archery sight tape selection application 246 can be configured for operation with Apple iOS, Google's Android, RIM's BlackBerry OS and Microsoft Windows Phone. The preceding provide some examples and the archery sight tape selection application 246 can be configured for operation with other operating systems.

Operating system 242 provides an interface to the hardware resources 244 for example the display employed to render a GUI for operation of the archery sight tape selection application 246. Accordingly, the operating system 242 can support a variety of displays including touch displays and other user interfaces. According to further embodiment, the operating system 242 can also communicate with other hardware such as communication interfaces (e.g., a cell phone), cameras, audio hardware, location systems such as GPS and other I/O devices using device drivers.

The operating system 242 can also communicate with hardware processing modules such as the graphics processing unit and/or the central processor executing operations and/or instructions during the archery sight tape selection process.

Archery sight tape selection application 246 can be an archery sight tape selection application executing on a device such as the mobile devices 179, stationary device 188 and other user devices 189. Archery sight tape selection application 246 can include an archery parameter input module 248, an archery sight tape selection module 253, a sight-setting generator 252, a user preferences engine 254 and an output sharing engine 256. These components can be communicatively coupled to one or more of each other. Though the components identified above are described as being separate or distinct, two or more of the components may be combined in a single process or routine. The functional description provided herein includes the separation of responsibility for distinct functions as an example. Other groupings or other divisions of functional responsibilities can be made as necessary or in accordance with design preferences. For example, in one embodiment, the functionality provided by the archery parameter input module 248, the archery sight tape selection module 253, and/or the sight-setting generator 252 can be combined in a single process.

While the application 246 is referred to as an "archery sight tape selection application," it will be apparent to those of ordinary skill in view of the disclosure provided herein, that the application 246 can be employed to determine and provide sight marks for use with archery sights that do not include a sight tape. For example, the application 246 can be employed to generate scaled sight marks for multi-pin bow sights. According to these embodiments, the sight setting generator 252 is employed to generate the sight marks for use as described with reference to FIGS. 11-18.

According to various embodiments, the archery parameter input module 248 is employed by a user to provide information concerning an identification of archery equipment, archery equipment settings and/or archery equipment performance for use in creating archery sight-settings. According to one embodiment, the archery parameter input module 248 can also be used to present display objects, for example, the display object 197, or other objects employed by the user to select one or more archery parameters used to create archery sight-settings. The functionality of the archery parameter input module 248 is described in further detail herein.

According to various embodiments, the sight setting generator 252 receives the archery parameters from the archery parameter input module 248, for example, archery parameter inputs provided by the user via selections made using the graphical user interface. The sight-setting generator determines the sight settings that result from the archery parameter inputs. These sight-settings provide the relative spacing of the sight marks for the given archery parameters where, for example, the given archery parameters are for selected archery equipment. According to one embodiment, the relative spacing provides a direct measure of the gap between adjacent sight marks and between selected sight marks and other selected sight marks that may not be adjacent to one another. Thus, in one embodiment, the sight settings provide a distance between a 20 yard sight mark and a 60 yard sight mark for the given archery parameters. For example, where the movement of the mechanically operated sight pins of the archery sight is in a 1:1 ratio with the movement of the alignment pin adjacent the sight tape. According to another embodiment, the sight settings provide differences in sight-pin elevation where the differences are correlated to the difference in a position of two sight marks on a setup tape. For example, where the movement of the mechanically operated sight pins of the archery sight is not in a 1:1 ratio with the movement of the alignment pin adjacent the setup tape and/or sight tape.

The immediately preceding situation is often found where the archery sight includes wheels, levers or other adjustment means such that the alignment pin travels proximate an arcuate surface as the elevation of the sight pin is adjusted. In a conventional approach the sight tape, marking tape and/or setup tape are each affixed to the arcuate surface. According to embodiments, described herein the archer need not employ a setup tape. According to a further embodiment, the archer need not even employ a marking tape. Instead, the archer sights in the archery equipment at one known shot distance. After employing the application 246, the archer aligns the mark on the selected sight tape that corresponds to the known shot distance with the alignment pin and secures the selected tape to the sight.

Because these distances (or "gaps") in each of the above-described embodiments are employed by the archery sight tape selection application 246 in a mathematical operation, the sight settings need not be displayed as sight marks in the graphical user interface. However, in one embodiment, the sight-setting generator 252 provides the sight settings for display as sight marks in the graphical user interface According to some embodiments, the archery sight tape selection module 253 receives the sight settings from the sight-setting generator 252. In various embodiments, the archery sight tape selection module 253 performs at least one mathematical operation with the information provided by the sight settings. For example, the mathematical operations can determine the distance separating various sight settings such as the sight settings for two predetermined shot-distances (the 20 yard sight setting and the 60 yard sight setting, for example). In further embodiments, the sight tape selection module 253 employs the results of these operations in at least one additional mathematical operation. According to some embodiments, the distance separating the predetermined sight marks is compared with one or more values in memory (for example, the memory 305 of the device 300 illustrated in FIG. 7). Depending on the embodiment, the stored values can include the distance separating sight marks for the two pre-determined shot distances on each of a plurality of sight tapes, the difference in pin elevation (i.e., the pin gap) resulting with the sight adjusted to a first pre-determined sight mark and then a second pre-determined sight mark for each of a plurality of sight tapes, respectively, or other stored value(s) that provide a reference for comparison with the sight settings.

In various embodiments, the sight tape selection module 253 selects the appropriate sight tape from among a plurality of sight tapes by determining the sight tape that includes sight marks that most closely match the sight settings generated by the sight setting tool generator. In a further embodiment, the sight tape selection module 253 outputs an identification of the selected sight tape for display in the graphical user interface. In one embodiment, the identification includes an indicia that uniquely identifies the selected sight tape. Further, the result of the operations performed by the sight tape selection module is a selection of a sight tape that provides sighted-in sight marks based on the archery parameters selected by the user.

According to some further embodiments, the user preferences engine 254 receives and stores user preferences used, for example, by the archery sight selection tape selection tool 253 and/or the sight setting generator 252. Accordingly, the user preferences engine can provide the information used to display a sight-tool format, a selected set of sight tapes, a make and model of the bow sight that the sight tape is to be used with, values of pre-determined shot-distances, and the ranges and functionality of information and display objects to allow the user to most efficiently receive a selection of a sight tape.

According to still further embodiments, the output sharing engine 256 receives one or more user inputs to define whether, and if so, how the sight tape selection and/or sight-settings are shared. According to some embodiments, user inputs can include a title, a tag (i.e., a description), selection of a geo-tag, and/or selection to share via one or more social media services. In various embodiments, the sight tape selection is shared along with one or more archery parameters, for example, equipment performance, equipment selection and/or equipment settings. Accordingly, the output sharing manager 256 can provide one or more display objects in the display 180 and received one or more touch inputs as the user's selections and preferences. FIG. 7 illustrates a block diagram of hardware architecture of a device 300 for use in archery sight tape selection in accordance with one embodiment. Depending on the embodiment, the hardware architecture illustrated in FIG. 8 can be included in the mobile device 179, the stationary device 188 or other user devices 189. In the illustrated embodiment, the device 300 includes one or more processors 304 (for example, a central processing unit (CPU), and/or a graphics processing unit (GPU) or other specialized processor), a memory 305, and a display 308. The memory 305 is configured to store software instructions 307 in accordance with various embodiments. The device 300 can also include communication systems 324 (for example, a cellular phone, Bluetooth, etc.) and a touch screen controller 326. According to some embodiments, the touch screen controller 326 is suitable for use with the display 308 in a touch screen configuration, or alternatively, a trackpad used to move a cursor within a GUI. Further, the device 300 can include peripheral and/or I/O devices 328 including any of a location and/or positioning device (for example, a GPS to determine location information associated with the device 300), a camera (for example, a video camera) and audio systems (for example, a microphone and/or speakers) as some examples. In some embodiments, I/O 328 can include a mouse used to move the cursor within the GUI. According to further embodiments, an audio system can be employed with a speech recognition system to allow hands-free interaction with the GUI.

The components included in the device 300 can be coupled by one or more communication buses or signal lines. The communication buses can be used for the communication of instructions/commands and data between the illustrated components and between the illustrated components and other components included in the device depending on the embodiment.

In various embodiments, the communication system 324 can include one or more wireless communication subsystems and one or more wired communication subsystems. Wireless communication systems can include RF communication systems and/or optical communication systems such as IR communication systems. The RF communication systems can provide for local communication such as via Bluetooth™ communication and/or long-distance communication, for example, via cellular and/or satellite communication networks.

The device 300 can also support hardwired communication systems in some embodiments, for example, communication via USB or other hardwired communication port included in the device 300. Depending on the embodiment, the hardwired communication can allow the device 300 to communicate with any of an electronic archery accessory such as those described in the '273 patent, a personal computer, a printer, a display screen, a router or other processing devices capable of receiving and/or transmitting voice or data.

In general, the device 300 is not limited to any specific communication hardware and/or protocol. Thus, for example, the communication systems can support any of a (GSM) network, a GPRS network, an enhanced data GSM environment (EDGE) network, 802.x communication networks (e.g., Wi-Fi, WiMax, or 3G networks), code division multiple access (CDMA) networks, a Bluetooth™ network, or other communication network depending on the embodiment.

According to one embodiment, the display 308 includes a touch screen display that can detect contact and movement or break thereof using any of a number of touch sensitivity technologies, including but not limited to capacitive, resistive, infrared, and surface acoustic wave technologies, as well as other proximity sensor arrays or other elements for determining one or more points of contact with display 308 or proximity to the display. According to one embodiment, the display 308 can be used to implement virtual or soft buttons and/or a keyboard or other display object 197.

According to various embodiments, the I/O devices 328 can include one or more buttons, rocker switches, thumbwheel, infrared port, USB port, and/or a pointer device such as a stylus.

In various embodiments, the memory 305 can include high-speed random access memory and/or non-volatile memory, such as RAM, EEPROM, flash memory magnetic storage devices and optical storage devices. In further embodiments, the memory 305 can store operating system such as, LINUX, UNIX, OS X, iOS, Android, bada, BlackBerry OS, Symbian OS, WINDOWS, WINDOWS phone for mobile, S40 (Series40) or any other OS operating on a mobile device or a stationary device. The operating system can include instructions for handling basic system services and for performing hardware dependent tasks. As mentioned above, the archery sight-setting application can be configured for a specific operating system in a selected embodiment.

In various embodiments, the memory 305 can also store communication instructions to facilitate communicating with one or more additional devices, one or more computers and/or one or more servers, for example, as described with reference to FIG. 5. In some embodiments, the memory includes instructions for rendering the graphical user interface in the display 180, for example, where the graphical user interface can be employed by the user to create and share archery sight-settings. According to these embodiments a variety of additional instructions can be included in the memory 305. For example, software instruction 307 can be provided for a variety of web browsing, media processing, telecommunications, camera and video related functions and GPS-enabled operations as some examples in addition to software instructions specifically related to the archery sighting functions.

Depending on the embodiment, the software instructions 307 can be implemented as individual software programs or modules, or combined with one or another in various configurations. Also depending on the embodiment, various functions of device 300 can be implemented in hardware and/or in software, including in one or more signal processing and/or application specific integrated circuits.

According to some embodiments, the memory 305 includes one or more databases for use in the sight tape selection process. Depending on the embodiment, the database(s) can include the distance separating sight marks for the two pre-determined shot distances on each of a plurality of sight tapes, the difference in pin elevation (i.e., the pin gap) resulting with the sight adjusted to a first pre-determined sight mark and then a second pre-determined sight mark for each of a plurality of sight tapes, respectively, or other stored value(s) that provide a reference for comparison with the sight settings. According to one embodiment, the memory 305 stores information identified by the bow sight and/or sight tape manufacturer such that the user can quickly access the relevant stored information for use in the process of selecting the correct sight tape for their bow sight.

Figure 7:
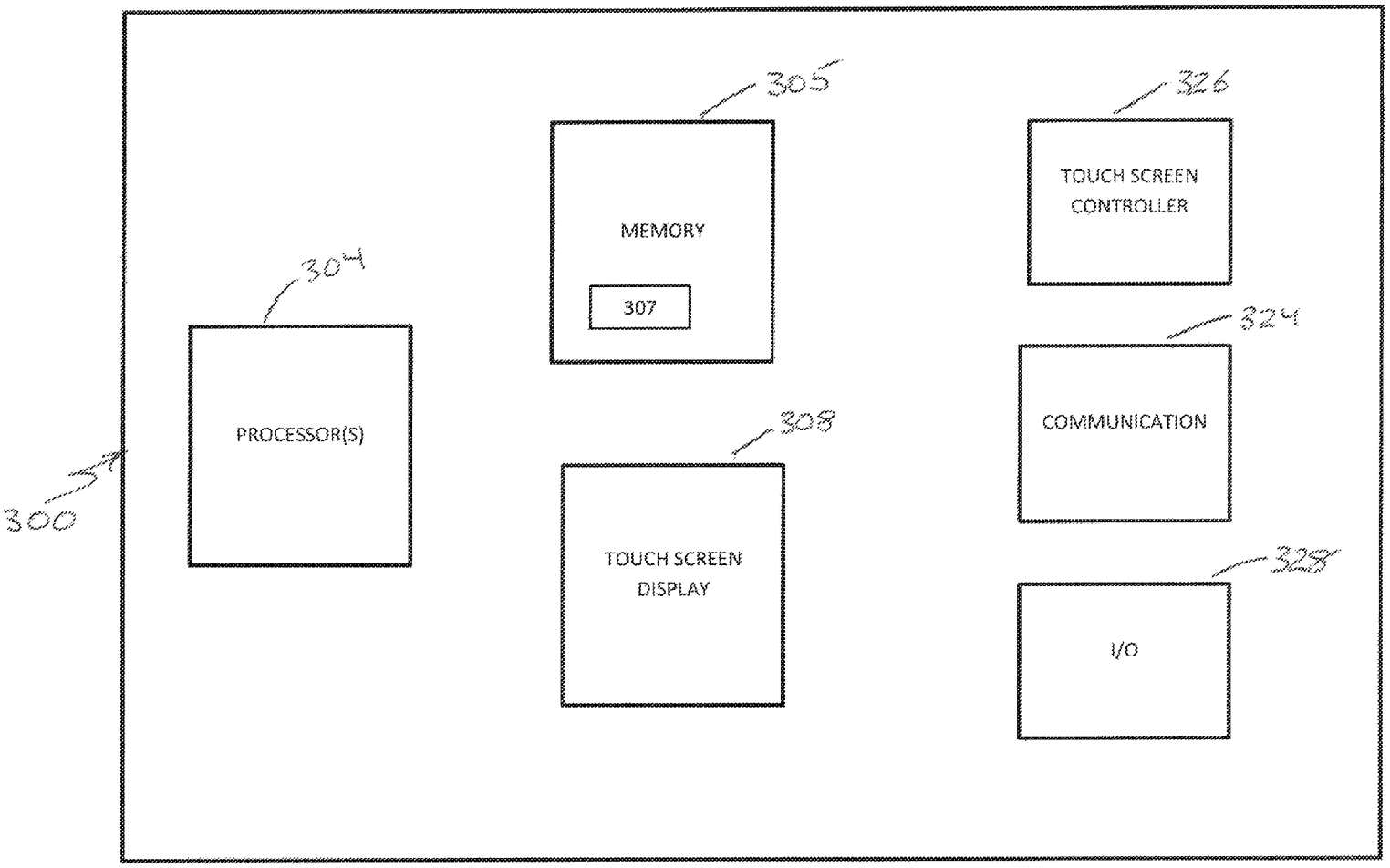
FIG. 7 illustrates a block diagram of a hardware architecture for a device in accordance with one embodiment.

The hierarchy illustrated in FIG. 6 and the device architecture illustrated in FIG. 7 provide examples in accordance with some embodiments. However, the hierarchy 240 can include more or different software elements and/or modules alone or in combination with those illustrated and described with reference to FIG. 6. Also, the device 300 can include more or different hardware elements and/or modules alone or in combination with those illustrated and described with reference to FIG. 7. In various embodiments, the systems illustrated in FIGS. 9 and 10, respectively, can be employed with the hierarchy illustrated in FIG. 6 and/or the architecture illustrated in FIG. 7.

Figure 8:
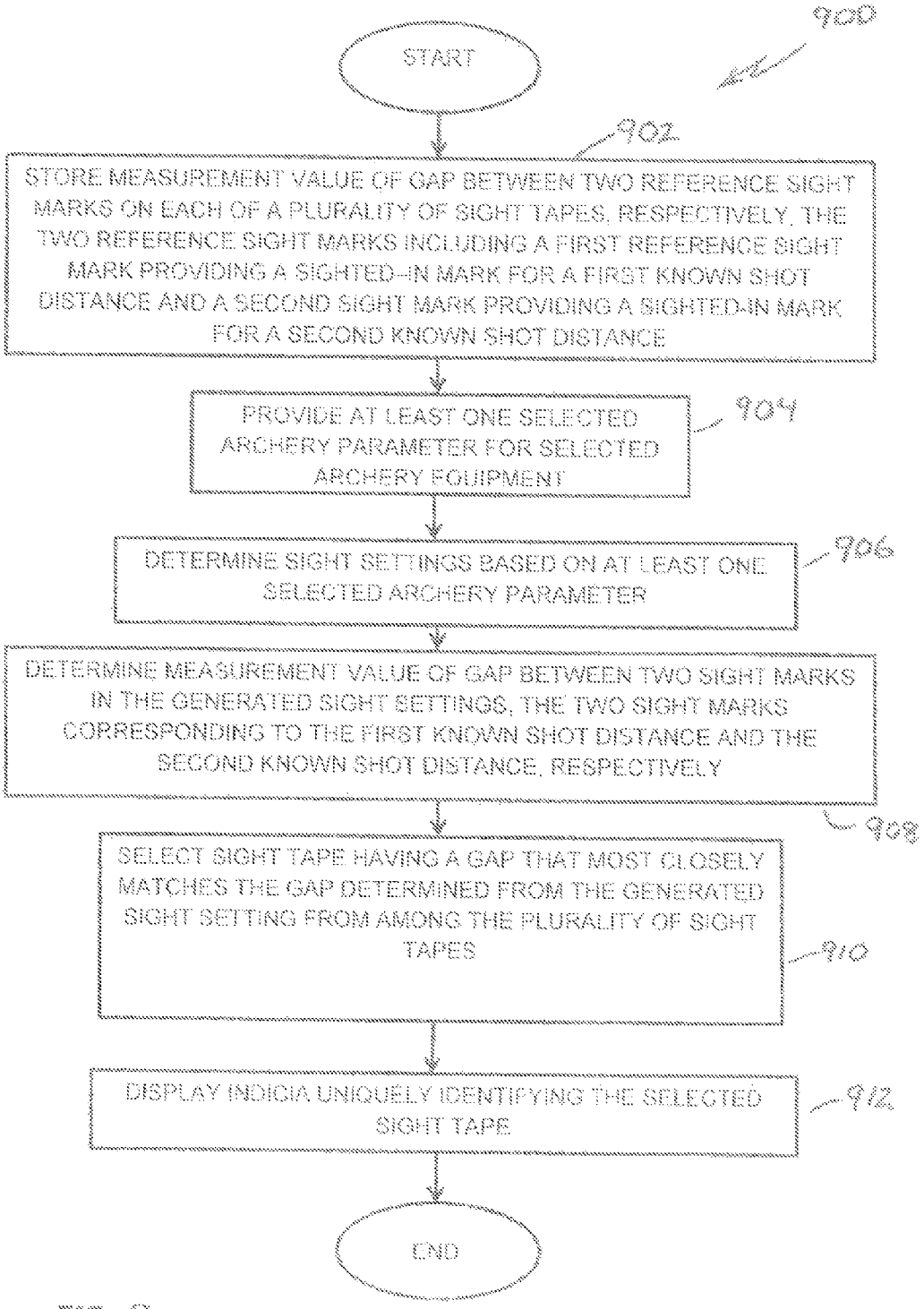
FIG. 8 illustrates a flow diagram of a process for identifying a sight tape included in a plurality of sight tapes for use with selected archery equipment in accordance with one embodiment.

Referring now to FIG. 8, a process 900 for sight tape selection is illustrated in accordance with one embodiment. The process begins at act 902 where a value is stored of the distance separating two reference sight marks on each of a plurality of sight tapes, respectively (for example, each of a plurality of sight tapes included in a set of sight tapes provide with a bow sight). According to this embodiment, the two reference sight marks include a first reference sight mark providing a sighted-in mark for a first known shot distance and a second reference sight mark providing a sighted-in mark for a second known shot distance.

At act 904, the process 900 continues with a user providing at least one selected archery parameter for selected archery equipment. The information provided can vary depending on the embodiment. According to some embodiments, the archery parameters are provided such that the trajectory of the arrow shot from the bow included in the selected archery equipment can be determined. According to some further embodiments, the parameters can allow a determination of a launch angle of an arrow to hit a bullseye at various distances for the given parameters.

At act 906, sight settings are determined based, at least in part, on the information provided at act 904. At act 908, a value is stored of the distance separating two sight marks in the sight settings determined at act 906. According to one embodiment, the two sight marks correspond to a sight mark for the first known shot distance and a sight mark for the second known shot distance, respectively.

At act 910, a sight tape included in the plurality of sight tapes is selected. According to the illustrated embodiment, the sight tape is selected because it includes the distance separating two reference sight marks on each of a plurality of sight tapes, respectively, that most closely matches the distance separating two sight marks in the sight settings as determined at act 906. The preceding can be achieved where the two reference sight marks on each of a plurality of sight tapes are for the first known shot distance and the second known shot distance respectively. The result is a selection of a best fit from among the set of sight tapes included in the set of sight tapes provided for the sight.

At act 912, the process 900 is completed when the sight tape identified at 910 is output for display. According to one embodiment, the indicia (for example, the identification letters 148 or identification numerals 149) is displayed to the user in the display 308 of the device 300 illustrated in FIG. 7. According to various embodiments, the indicia provided to the user uniquely identifies the selected sight tape.

Further, the user need only sight-in the selected archery equipment at a single shot-distance to properly locate the sight tape on the archery sight. Once the sight tape is so located the set of sight marks provided by the sight tape are sighted-in for the full sight tape.

Figure 9:
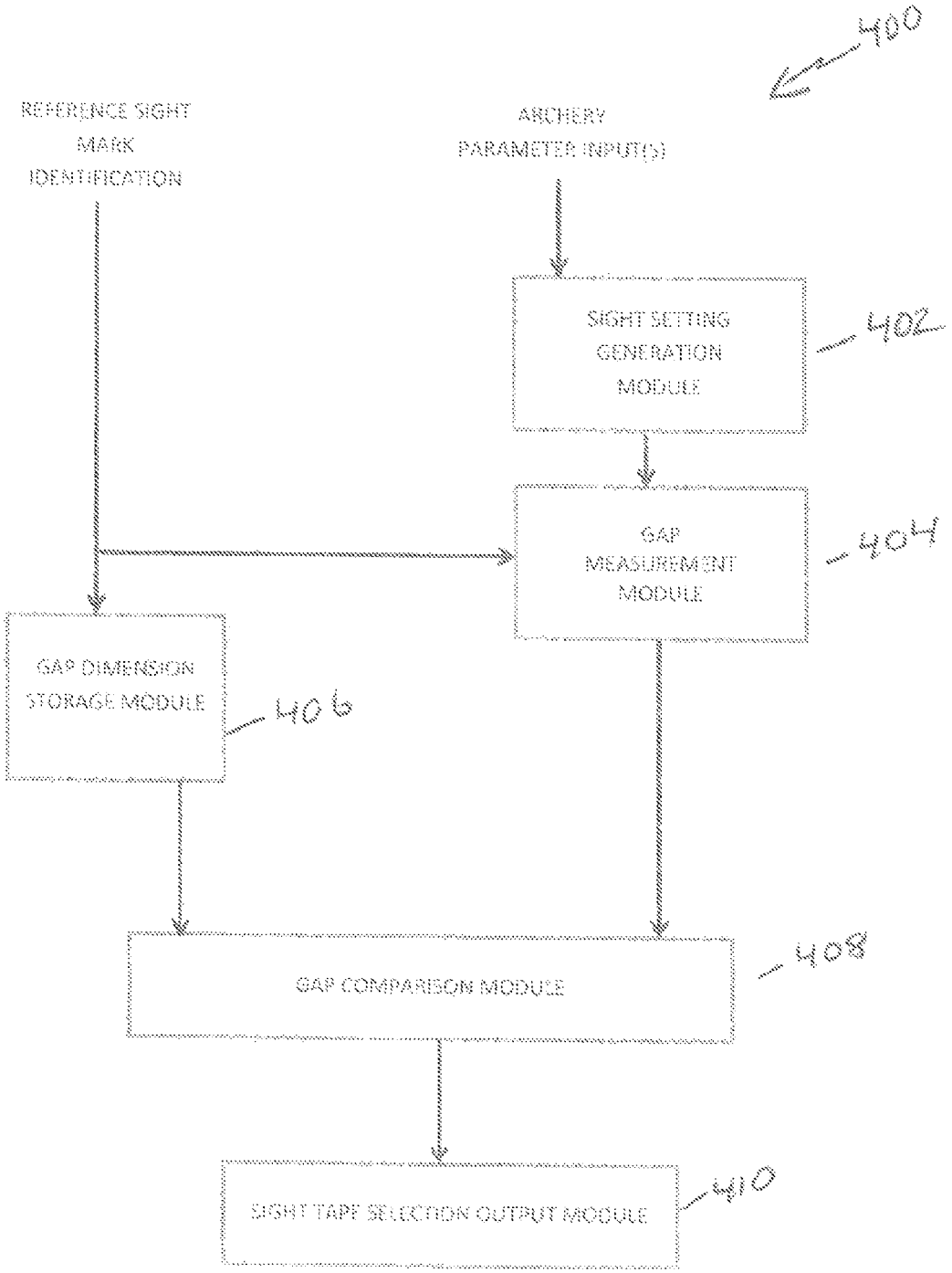
FIG. 9 illustrates a system in accordance with one embodiment.

Referring now to FIG. 9, a system 400 for sight tape selection is illustrated in accordance with one embodiment. According to the illustrated embodiment, the system 400 includes a sight setting generation module 402, a gap measurement module 404, a gap dimension storage module 406, a gap comparison module 408 and a sight tape output module 410. Further, information provided to the system can include a reference sight mark identification, archery parameter inputs, bow sight manufacturer and/or sight tape manufacturer as some examples. The information can be provided by the application, provided by the user and/or be provided as a default after an initial selection by a user. As one example, the reference sight marks can be fixed by the application (for example, 20 yards and 60 yards) while at least some of the archery parameters are provided by the user concerning the performance and/or settings of their selected archery equipment.

According to one embodiment, the sight generation module 402 receives the archery parameters as input and establishes sight settings based on the parameters. In general, the archery parameters provide the sight generation module 402 with the information necessary to determine a trajectory of the arrow shot from the bow for the selected archery equipment for a given launch angle. For example, the archery parameters can include arrow speed, arrow drag and/or vane and shaft types, and peep measurements. In one embodiment, the drag is estimated by the application. The sight generation module employs to parameters to determine the launch angle of the arrow needed to hit the bullseye at various distances for those given parameters. Further, the sight generation module determines the sight marks for the various distances based on the archery parameters, for example, the peep-to-sight and the peep-to-arrow measurements.

In the illustrated embodiment, the gap measurement module 404 determines a distance between two sight settings, for example, sight settings for the shot-distances associated with the reference sight marks. The gap dimension storage module 406 includes stored values of the distance separating sight marks for the two pre-determined shot distances on each of a plurality of sight tapes, the difference in pin elevation (i.e., the pin gap) resulting with the sight adjusted to a first pre-determined sight mark and then a second pre-determined sight mark for each of a plurality of sight tapes, respectively, or other stored value(s) that provide a reference for comparison with the sight settings.

The gap comparison module 408 receives a first distance output from the gap measurement module 404 and at least one of the stored values provided by the gap dimension storage module 406. According to some embodiments, the gap comparison module 408 receives a plurality of stored values (for example, one for each sight tape included in a set of sight tapes). The gap comparison module 408 compares the first distance received from the gap measurement module 404 with the stored value(s) received from the gap dimension storage module 406 until a closest match is identified. The gap comparison module 408 provides an identification of the sight tape providing the closest match to the sight tape selection output module 410. The sight tape selection output module 410 provides an identifier as an output for display to the user where the identifier uniquely identifies the sight tape identified by the gap comparison module.

Figure 10:
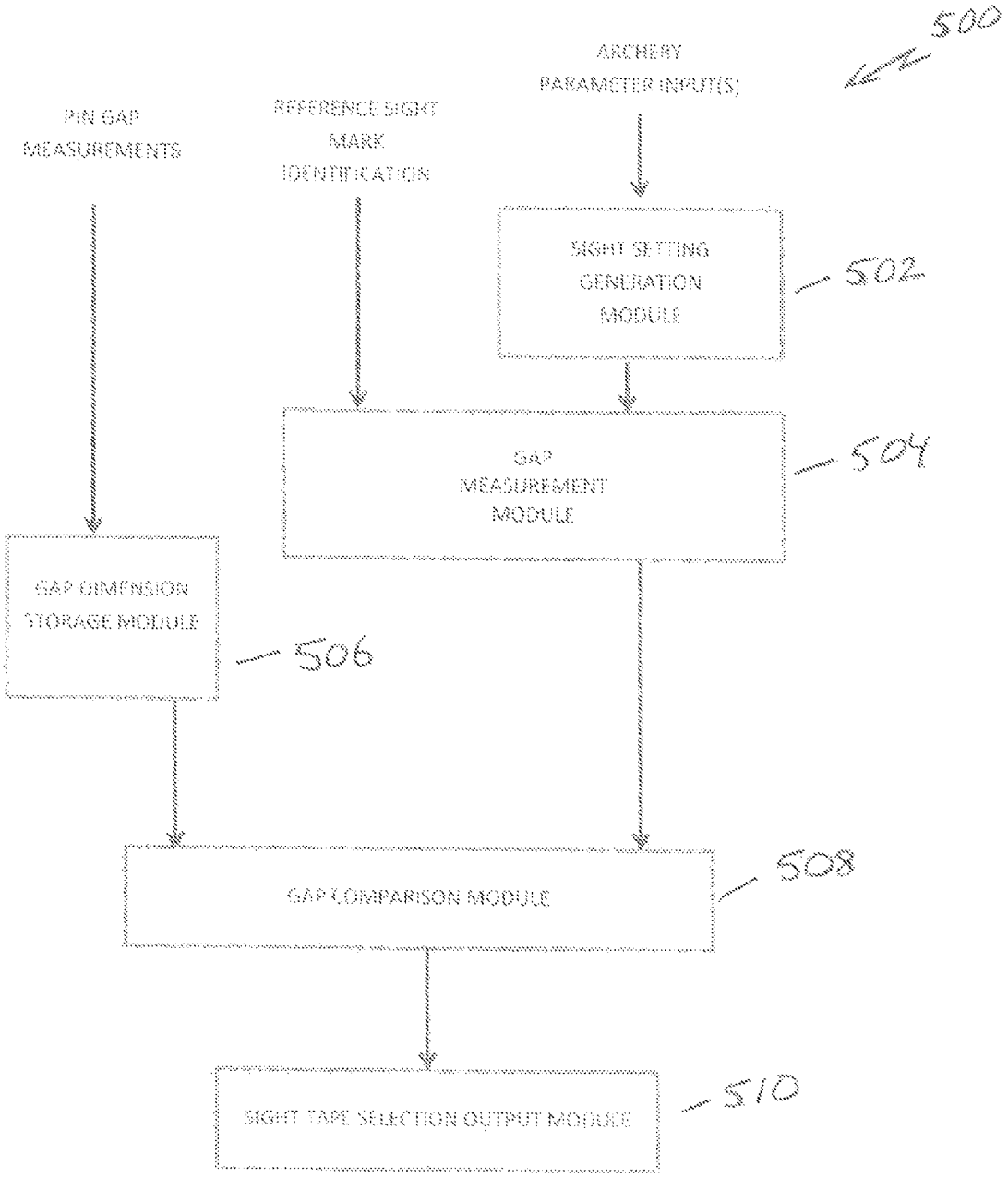
FIG. 10 illustrates a system in accordance with another embodiment.

Referring now to FIG. 10, a system 500 for sight tape selection is illustrated in accordance with another embodiment. According to the illustrated embodiment, the system 500 includes a sight setting generation module 502, a gap measurement module 504, a gap dimension storage module 506, a gap comparison module 508 and a sight tape output module 510. According to one embodiment, the system 500 is employed for archery sights in which the movement of the mechanically operated sight pin(s) of the archery sight is not in a 1:1 ratio with the movement of the alignment pin adjacent the setup tape and/or sight tape.

According to various embodiments, information provided to the system can include a reference sight mark identification, archery parameter inputs, pin gap measurements, bow sight manufacturer and/or sight tape manufacturer as some examples. For example, for a set of sight marks provided by a particular sight tape (for example, a uniquely identified sight tape), and for a particular make and model bow sight, a change in pin elevation when the sight is adjusted between a first sight mark and a second sight mark on the sight tape can be measured. In some embodiments, the preceding is performed for the same two sight marks (for example, 20 yards and 60 yards) on each of the respective sight tapes in a set of sight tapes. The set of "pin gap" measurements for the particular sight and set of sight tapes is provided to the system 500. In further embodiments, the preceding pin gap measurements are arrived at using a setup tape rather than each sight tape where, for example, the setup tape can be employed to establish the relative difference between a pin position established for a first known shot-distance and a pin position for a second known shot-distance for each sight tape included in a plurality of sight tapes.

The information can be provided by the application, provided by the user and/or be provided as a default after an initial selection by a user. As one example, the reference sight marks can be fixed by the application (for example, 20 yards and 60 yards) while at least some of the archery parameters are provided by the user concerning the performance and/or settings of their selected archery equipment. According to one embodiment, the sight-pin gap measurements for one or more brands of sight tapes are provided by the application. Because changes in sight-pin elevation must be measured to one hundredth of an inch, the preceding provides a substantial advantage. For example, embodiments described herein can quickly provide the user with a sight tape selection using a process that does not require the user to make detailed measurements to the hundredth of an inch or perform mathematical operations.

According to one embodiment, the sight generation module 502 receives the archery parameters as input and establishes sight settings based on the parameters. In general, the archery parameters provide the sight generation module 502 with the information necessary to determine a trajectory of the arrow shot from the bow for the selected archery equipment. For example, the archery parameters can include arrow speed, arrow drag and/or vane and shaft types, and peep measurements. In one embodiment, the drag is estimated by the application. The sight generation module 502 employs to parameters to determine the launch angle of the arrow needed to hit the bullseye at various distances for those given parameters. Further, the sight generation module determines the sight marks for the various distances based on the archery parameters.

In the illustrated embodiment, the gap measurement module 504 determines a distance between two sight settings, for example, sight settings for the shot-distances associated with the reference sight marks. In one embodiment, the reference sight marks (for example, 20 yards and 60 yards) are provided as default values by the application. In further embodiments, the user can custom select the reference sight marks so, for example, the user can use 20 yards and 80 yards as the reference sight marks. The gap dimension storage module 506 includes stored values of the difference in sight-pin elevation (i.e., the pin gap) resulting with the sight adjusted to a first pre-determined sight mark and then a second pre-determined sight mark for each of a plurality of sight tapes, respectively, or other stored value(s) that provide a reference for comparison with the sight settings.

The gap comparison module 508 receives a first distance output from the gap measurement module 504 and at least one of the stored values provided by the gap dimension storage module 506. According to some embodiments, the gap comparison module 508 receives a plurality of stored values (for example, one corresponding to each sight tape included in a set of sight tapes). The gap comparison module 508 compares the first distance received from the gap measurement module 504 with the stored value(s) received form the gap dimension storage module 506 until a closest match is identified. The gap comparison module 508 provides an identification of the sight tape providing the closest match to the sight tape selection output module 510. The sight tape selection output module 510 provides an identifier as an output to the user where the identifier uniquely identifies the sight tape identified by the gap comparison module.

Although illustrated and described with reference to the embodiments of FIGS. 9 and 10, respectively, systems 400, 500 can be configured differently depending on the embodiment. In general, the components of the respective systems 400, 500 can be communicatively coupled to one or more of each other. Further, though the components identified above with reference to FIGS. 9 and 10 are described as being separate or distinct, two or more of the components may be combined in a single process or routine. The functional description provided herein includes the separation of responsibility for distinct functions as an example. Other groupings or other divisions of functional responsibilities can be made as necessary or in accordance with design preferences. For example, some of the illustrated modules can be combined or eliminated in various embodiments while in further embodiments other modules can be added. According to one embodiment, the sight setting generation module and the gap measurement module are combined into a single module. According to another embodiment, the gap dimension storage module is included in the gap comparison module. In still another embodiment, sight tape selection output module is included in the gap comparison module.

Figure 19:
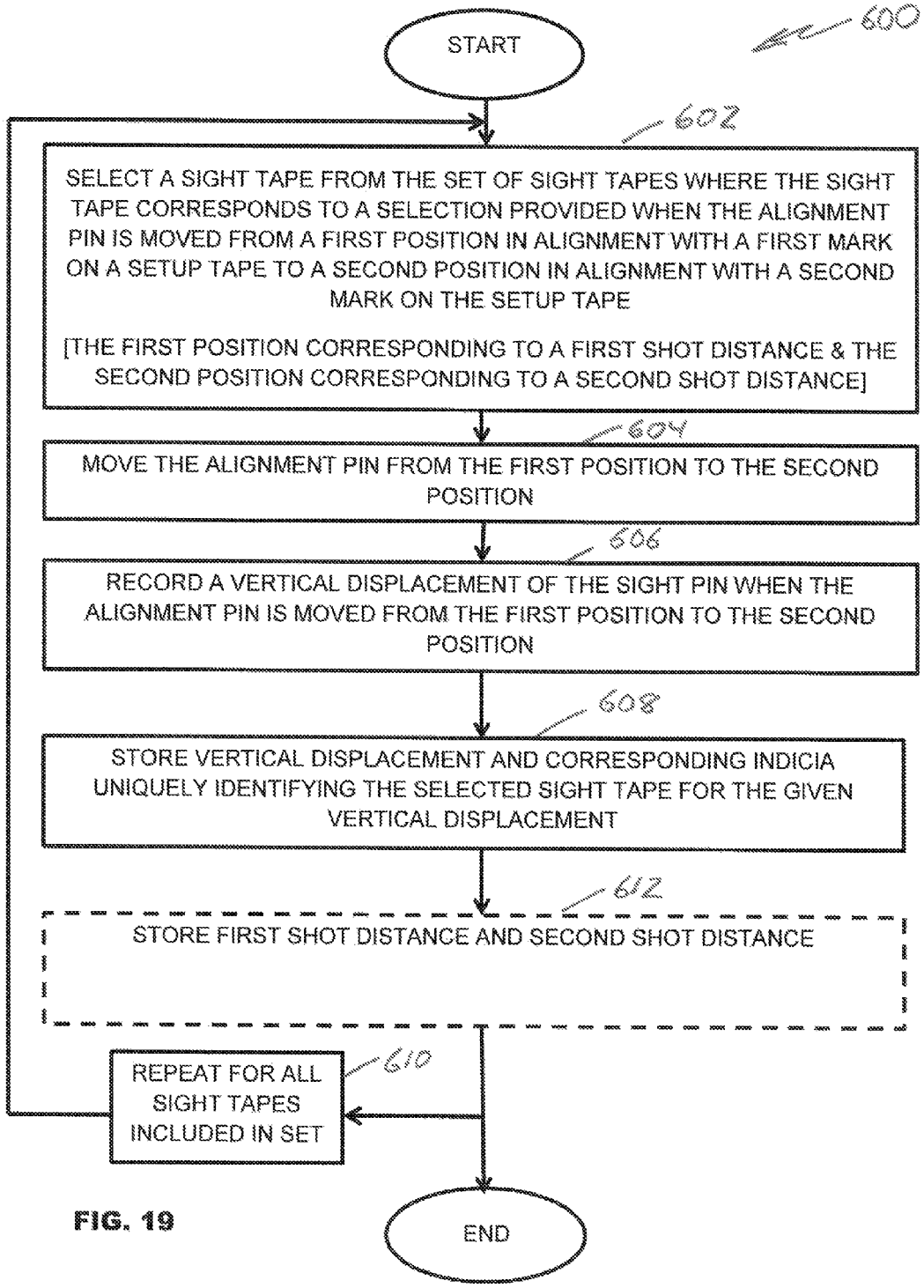
FIG. 19 illustrates a process to provide information concerning a set of sight tapes in accordance with one embodiment.

According to some embodiments, either or both of the systems 400, 500 can be included in the archery sight tape selection application 246 executing on a device such as the mobile devices 179, stationary device 188 and other user devices 189. In some embodiments, a first portion of either or both systems 400, 500 is included in the sight setting generator 252, for example, either or both of the sight setting generation module 402 and sight setting generation module 502. Similarly, one or more of the gap dimension storage modules 406, 506, the gap measurement modules 404, 504, the gap comparison modules 408, 508, and the sight tape selection output modules 410, 510 can be included in the archery sight tape selection module 253. Referring now to FIG. 19, a process 600 for establishing a change in vertical displacement of a sight pin at two known shot-distances (i.e., establishing a pin gap) for a sight tape selected from a set of sight tapes is provided. As described in more detail below, the process 600 can be employed to establish the preceding for each sight tape included in a set of sight tapes, respectively. According to one embodiment, the same two shot-distances are employed to establish the respective pin gap corresponding to each of the sight tapes included in the set of sight tapes. According to one embodiment, the process 600 is employed to record the correspondence between known shot distances sight pin displacement for the known shot distances and each of a set of uniquely identified sight tapes. This information can be employed by the system 500 illustrated in FIG. 10, for example, it can be stored by the gap dimension storage module 506.

According to one embodiment, each sight tape included in the set of tapes corresponds to a selection provided when the alignment pin is moved from a first position in which it is aligned with a first mark on a setup tape to a second position in which it is aligned with a second mark on the setup tape. According to one embodiment, where the first setup tape 142 of FIG. 3 is used, the sight tape 1411 marked with the indicia "50" corresponds to the selection that results when the alignment pin is placed adjacent two different marks when sighted in a first shot distance and a second shot distance, respectively, with setup tape secured to the sight. According to one embodiment, the first mark is 65, the second mark is 15 and sight tape "50" is identified following the mathematical operation 65-15. According to one embodiment, where the second setup tape 143 of FIG. 3 is used, the sight tape 141A marked with the indicia "42" corresponds to the selection that results when the alignment pin is located adjacent the first sight mark 145 when the archery equipment is sighted in at the first shot distance. The alignment pin is located adjacent the sight mark "M" when the archery equipment is sighted in at the second shot distance.

The process 600 begins at step 602 where a tape is selected from the set of sight tapes. At act 604, the alignment pin is moved from a first position to a second position where the first position corresponds to a position for a first known shot distance and the second position corresponds to a position for a second known shot distance, for the selected sight tape.

At act 606, a vertical displacement of the sight pin is recorded when the alignment pin is moved from the first position to the second position. For each sight tape in the set that is uniquely identified relative to other tapes in the set a unique displacement will be measured.

At act 608, the vertical displacement and corresponding indicia uniquely identifying the corresponding sight tape is stored. Optionally, the first shot distance and the second shot distance are also recorded and stored.

At act 610, the process returns to act 602 for another uniquely identified tape included in the set of sight tapes. Acts, 602, 604, 606, 608 and optionally 612 are repeated for the tape. The process can be repeated as necessary to provide the vertical displacement and corresponding indicia uniquely identifying the corresponding sight tape is stored. The process can employ the same first shot distance and second shot distance when determining the preceding for each tape.

Figure 20:
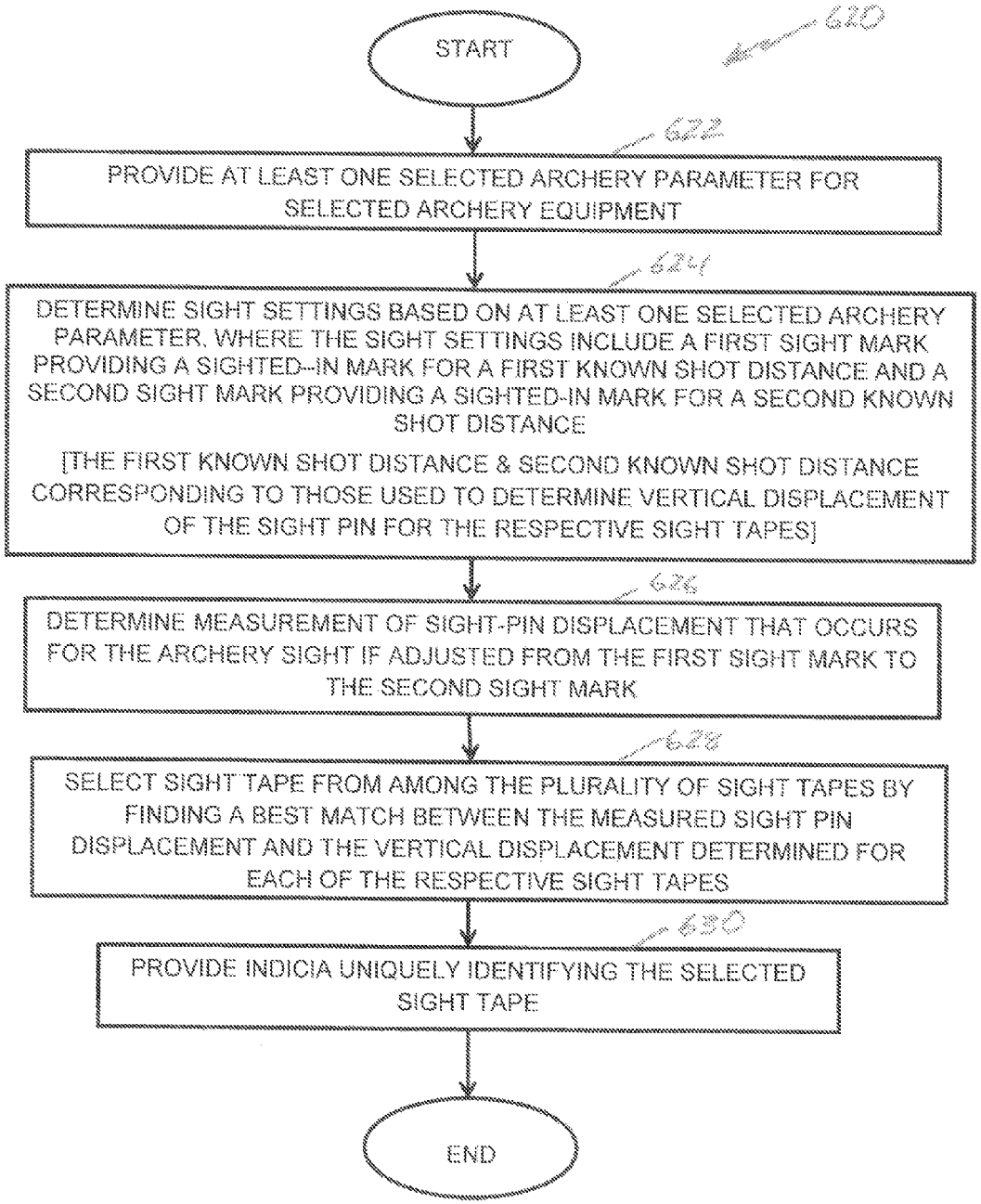
FIG. 20 illustrates a process to identify a sight tape in accordance with one embodiment.

The process provides a set of information that can then be employed in a process that allows accurate sight tape selection before the archer has even set a single sight mark for their archery equipment. FIG. 20 illustrates a process 620 that employs the information provided by the process 600 to do just that.

The process 620 begins at act 622 where at least one archery parameter is provided for selected archery equipment. In one embodiment, arrow speed and at least one peep-measurement are provided. In a further embodiment, both a peep-to-sight measurement and a peep-to-arrow measurement are provided. In some embodiments, a value of arrow drag is provided. In a further embodiment, the value of arrow drag is determined by the archery sight tape selection application 246 based, in part, on information concerning the arrow build (for example, a selection of vanes or feathers).

At act 624 sight settings are determined based on the at least one archery parameter provided at act 622. The sight settings include a first sight mark providing a sighted-in mark for a first known shot distance and a second sight mark providing a sighted-in mark for a second known shot distance. Further, the first known shot distance and the second known distance correspond to those used to determine the vertical displacement of the sight pin for the respective sight tapes in the process 600.

According to one embodiment, the sight marks employed in the process 620 are the marks that correspond to the sight pin position on a 1:1 ratio. At act 626, the gap between the first sight mark and the second sight mark is determined. Adjustment of the sight from the first sight mark to the second sight mark would result in a sight-pin displacement equal to a distance separating the sight marks. With the information available form the process 600 and stored in the application, the process 620 can directly select the sight tape with the closest matching gap even when there is a difference in travel between the sight pin and the alignment pin, i.e., they do not travel on a 1:1 ratio. The measurement determined at act 626 is employed in a comparison that occurs at act 628 in the illustrated embodiment. According to another embodiment, the process 620 includes a separate comparison step between act 626 and act 628.

At act 628, a sight tape is selected from among the plurality of sight tapes included in the set of sight tapes. The sight tape is selected by comparing the measured gap determined at act 626 with the previously stored gaps for the same two known shot distances corresponding to each of the sight tapes included in the set of sight tapes. Where the sight-pin/alignment-pin travel occurs on a 1:1 basis the gap provided on the sight tape is employed in the comparison. Where the sight-pin/alignment-pin travel does not occur on a 1:1 basis, the difference in sight pin elevation when the sight is adjust between two known marks on the setup tape is employed in the comparison. Act 628 results in determination of the sight tape that has the closest match between the pin-gap for the two known shot distances and the pingap determined at act 626. At act 630, the indicia that uniquely identifies the selected sight tape is provided. For example, the archery sight tape selection application 246 can display the indicia in the apparatus 200. The process ends after act 630.

Various embodiments of the apparatus, systems and methods described herein employ an electronic display device to generate sight settings for archery sights that include mechanically-adjusted archery sight pins. According to some embodiments, one or more archery parameters provided by a user are employed to generate the sight settings and automatically select the correct sight tape based on the archery parameters.

FIGS. 11-18 illustrate a graphical user interface in accordance with various embodiments. According to one embodiment, the graphical user interface is provided in a touch sensitive display. In general, the operations described with reference to FIGS. 11-18 can be performed with the mobile device 179, the stationary device 188 and the other devices 189 illustrated in FIG. 5. Accordingly, the embodiments described with reference to FIGS. 11-18 illustrate a series of display objects of a graphical user interface presented in the display to allow a user to interact with the archery application(s), for example, the archery sight tape selection application 246 described herein. According to some embodiments, the user selects the operation associated with an icon by providing an input in the region of the display where the icon is located, for example, a touch input in embodiments in which the display is touch-sensitive, a mouse click in embodiments where a cursor is used or a voice command in embodiments in which the system and apparatus are voice activated.

Figure 11:
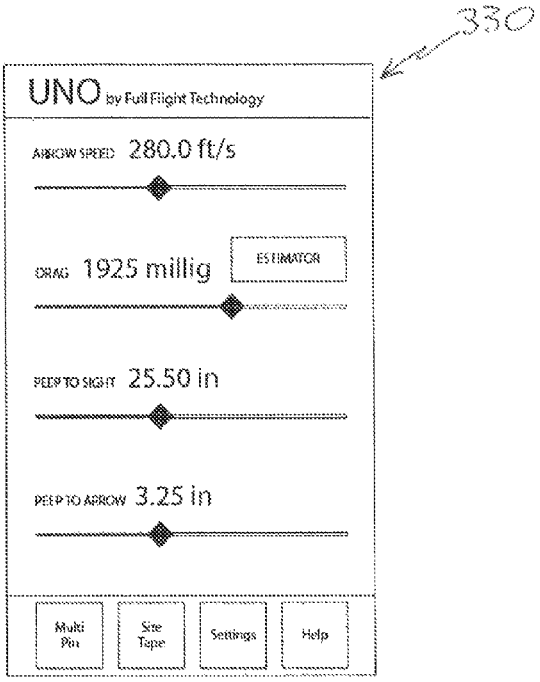
FIGS. 11-18 illustrate a series of user interfaces in accordance with one embodiment.

Referring to FIGS. 11-18, a graphical user interface (a GUI) is presented in a display in accordance with various embodiments. According to the embodiment illustrated in FIG. 11, a graphical user interface 330 includes a set of sliders to allow a user to enter archery parameters from which sight settings are determined and a sight tape selected. In the illustrated embodiment, the archery parameters include an arrow speed, an arrow drag, a peep-to-sight dimension and a peep-to-arrow dimension. According to some embodiments, one or a plurality of display objects 197 are presented in the display 180 to allow a user to customize the archery sight tape selection tool for their equipment and their preferences. According to one embodiment, the user preferences engine at least partly controls the style and type of information presented in the display 180 to consistent with the user's customized preferences. For example, the display objects can allow the user to select a particular make and model bow sight and/or sight tape manufacturer so that the sight tape selection application 246 employs the correct set of stored values of gap dimensions when selecting the proper sight tape. The GUI 330 also includes a menu bar that includes a set of display objects (for example, icons) that can be used to navigate to various others of the interfaces provided by the application 246. The example provided by FIG. 11 is non-limiting because different combinations of parameters can be employed in combination depending on the embodiment. Further, the display object can be provided in other forms to allow the user to select archery parameters using icons, keypads and thumbwheels as some examples.

Figure 12:
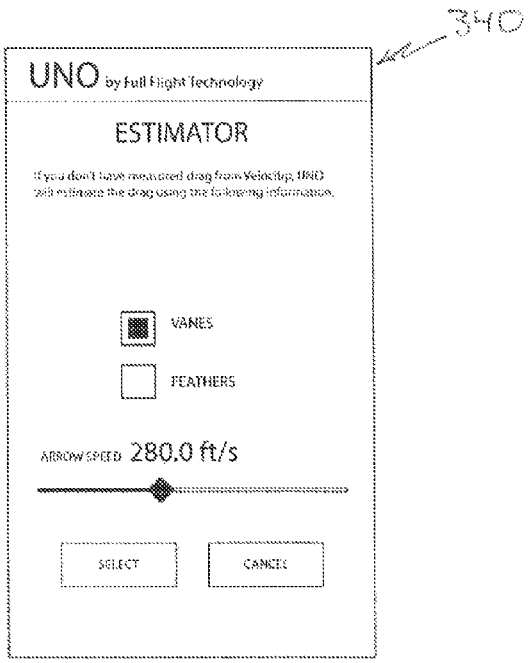

Referring to FIG. 12, a graphical user interface 340 is illustrated in accordance with one embodiment. The GUI 340 is provided when a user selects a display object in the GUI 330 to request that an estimated drag be provided by the application 246, for example, where the user does not have access to an arrow mounted sensing system to directly record the drag of their equipment. In this embodiment, the user employs the "Estimator" by selecting whether the selected archery equipment employs vanes or feathers and provides an arrow speed. The application employs this information to generate an estimated drag for use in determining the sight settings.

Because sight tape selection does not require a display of sight marks, the archery sight tape selection application can employ the archery parameters provided by the GUIs 330, 340 to mathematically generate sight settings and then select the sight tape that most closely matches the calculated sight settings.

Figure 13:
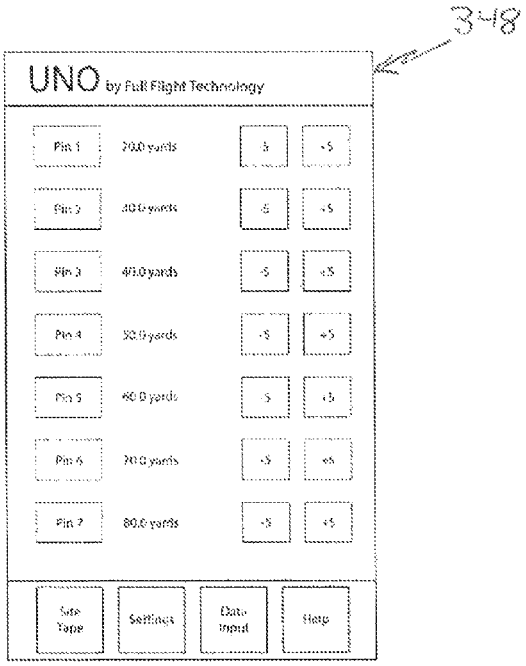
Figure 14:
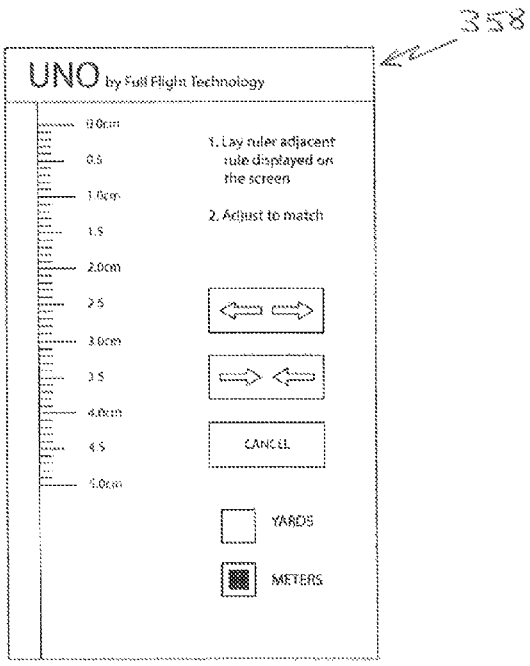

FIGS. 11-18 provide a series of graphical user interfaces for use in generating and displaying sight marks in the GUI. For example, FIGS. 11-18 can be employed with the archery sight setting application 246 as described herein. For example, FIG. 13 illustrates a graphical user interface 348 by which the user can select the shot-distance, quantity and color of sight marks for display to match the characteristics of their bow sight according to one embodiment. FIG. 14 illustrates a graphical user interface 358 by which the user can calibrate the scale of the display of their device 179, 188, 189 and 300 according to one embodiment. The calibration can be used to adjust the output displayed in the GUI illustrated in FIGS. 15-18 such that the sight marks are displayed to-scale. That is, spacing of sight marks displayed in the GUI is on a 1:1 ratio relative to the actual scale of the spacing of the sight pins and/or sight marks on the archery bow sight.

Figure 15:
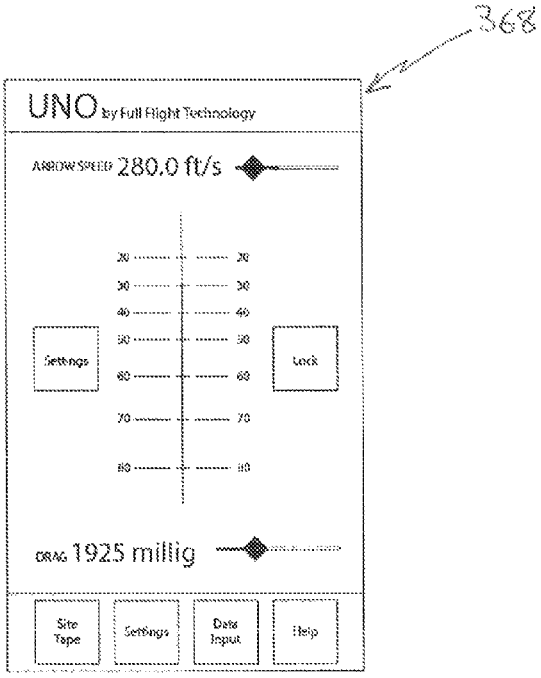
Figure 16:
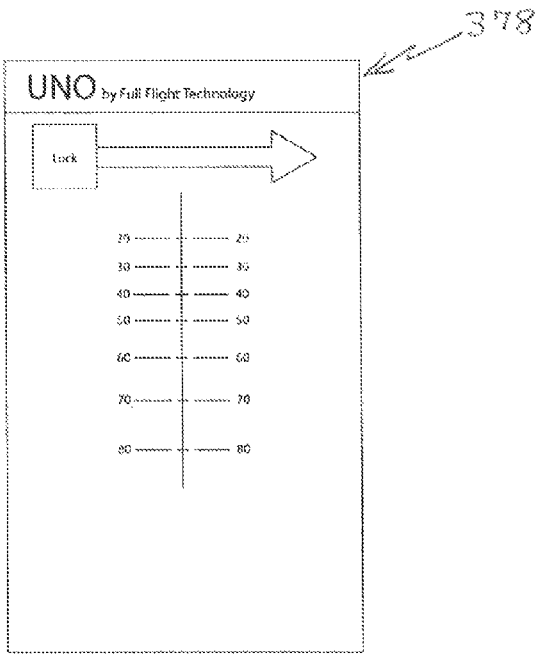
Figure 17:
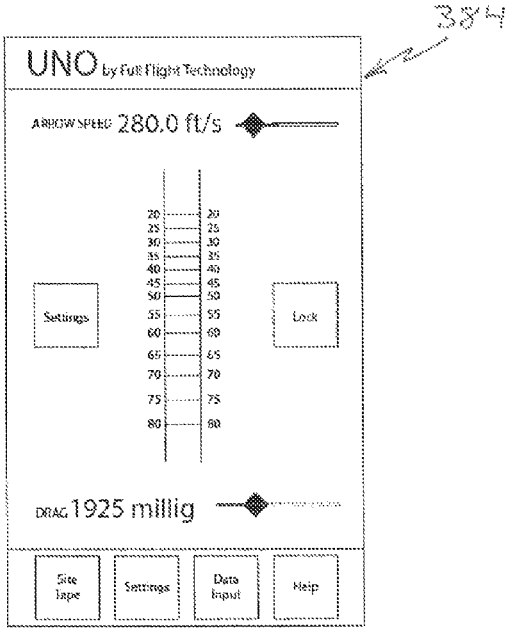
Figure 18:
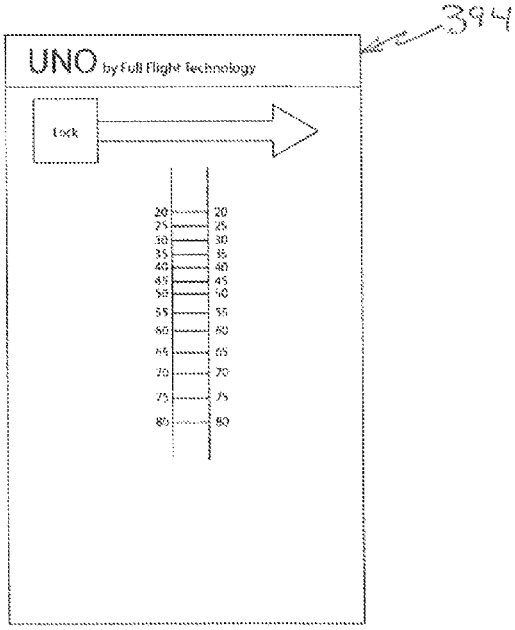

FIG. 15 illustrates a graphical user interface 368 that provides a sight-mark output according to one embodiment. The sight marks displayed in the graphical user interface 368 illustrate pin locations for various shot distances, for example, as used with a multi-pin sight. According to the illustrated embodiment, the GUI 368 also includes a pair of display objects in the form of micro-adjust sliders that allow the user to further refine the values of some of the archery parameters employed to determine the sight settings. FIG. 16 illustrates a graphical user interface 378 that includes the sight marks provided in the GUI 368 in a state in which the sight marks are "locked" to prevent adjustment according to one embodiment, for example, while the user sets the position of the sight pins on their bow sight. With the GUI 368 in a locked state, a user can easily place the phone up to the bow sight and move the pins located in the bow sight into alignment with the associated virtual pin displayed in the GUI 368. This results in accurate pin gaps being established for the sight. In practice, the bow is sighted in at a single shot distance and a location of the pin corresponding to the shot distance being fixed. The user then employs that pin as a reference when locating the phone adjacent the bow sight and setting a position of the other pins. FIG. 17 illustrates a graphical user interface 384 including sight marks presented in the form of a sight tape in accordance with one embodiment. According to the illustrated embodiment, the GUI 384 also includes a pair of display objects in the form of micro-adjust sliders that allow the user to further refine the values of some of the archery parameters employed to determine the sight settings used to generate the sight marks that are displayed. FIG. 18 illustrates a graphical user interface 394 that includes the sight marks provided in the GUI 384 in a state in which the sight marks are "locked" to prevent adjustment according to one embodiment, for example, while the user lays a blank sight tape on the display to hand mark a custom sight tape for the selected archery equipment. In one embodiment, the sight tape can be for a bow sight in which the alignment pin travels in a 1:1 ratio with the sight pin. In another embodiment, the sight tape can be for a bow sight in which the alignment pin travels in other than 1:1 ratio with the sight pin. According to these embodiments, the user creates a hard copy of the virtual sight tape. The user then attaches the sight tape to the archery sight, for example, by securing the sight tape to the face 127 illustrated in FIG. 1.

In some embodiments, one or more of the graphical user interfaces illustrated in FIGS. 11-18 include either or both of a print display object and a share display object. The print display object can be employed by a user to print a hardcopy of the scaled sight marks. In one embodiment, wireless printing is employed. In another embodiment, a file is generated and saved where the user can later print the scaled sight marks from the file either using a hardwired connection to a printer or a wireless connection. When selected, the share display object can be employed by the user to share image-files of the sight marks generated by the archery sight tape selection application 246 via email, social media and the like.

Referring to FIGS. 11-18, the graphical user interface presented in the display of the device 179 in accordance with further embodiments that provide for approaches for selecting sight tapes and also for transferring sight marks to an archery sight in accordance with alternate embodiments. According to these alternate embodiments, a selection of the archery parameters results in a generation of sight marks corresponding to the selected archery parameters. According to various embodiments, the plurality of sight marks are presented in the GUI with a 1:1 ratio between a first distance separating a first sight mark and a second sight mark in the GUI and a second distance separating a first sighted-in position and a second sighted-in position of the archery sight. Referring again to FIGS. 17 and 18, an approach for transferring the sight marks to a sight tape for an archery sight is illustrated in accordance with one embodiment.

The approaches described herein with reference to "sight tapes" or "a sight tape" can also be employed with archery sights (for example, the sight 120) in which the indicia (for example, the indicia 132) are placed directly on the sight 120, for example, where the indicia 132 are engraved or otherwise marked on the face 127 or another part of the sight 120. Further, the approaches described herein can be employed with a sight that has a first fixed set of indicia placed on the face (including versions where the face is placed on a wheel or other arcuate surface) and a second related set of indicia spaced on an adjusted arm that varies the distance of the face from the sight pin 124. Accordingly, one of skill in the art will recognize that aspects and embodiments can be employed with an archery sight 120 that does not include any removable "tape" or other removable marking material. Further, the archery sight 120 can include a plurality of sight pins within the housing 122 such that movement of moveable portion of the housing 122 raises or lowers the plurality of sight pins together.

Although primarily described with reference to a portable device, depending on the embodiment, the apparatus, systems and methods described herein can be implemented using portable or stationary devices, including devices having a temporary or permanent fixed location. Further, although some embodiments are described herein with reference to a touchscreen display, the apparatus, systems and methods described herein can be also be implemented using devices having other forms of display.

Although illustrated as a combination of specialized hardware and software, various aspects of the system 178 such as the application, and/or services 192 can be implemented as specialized software executing in a general purpose computing device such as a PC, a laptop, a tablet computer or other handheld computing device. The computing device can include, for example, a processor connected to one or memory devices, such as a disk drive, flash drive, memory or other device for storing data. Depending on the embodiment, the computing device can communicate over hardwired or wireless communication interfaces with one or more other devices including, for example, the host system. Accordingly, any of the embodiments described herein can include a non-transitory computer readable medium in which signals are stored that when executed by a processing system implementing aspects described herein. Further, in some embodiments, the system 178 can employ client and server computing devices, for example, in a configuration in which one or more of the devices (179, 188 and 189) operate as the client and the services 192 operate as the server.

Further, aspects can be implemented with a specially-programmed, special purpose hardware, for example, an application-specific integrated circuit (ASIC). Aspects of the invention can be implemented in software, hardware or firmware or any combination thereof. Such methods, acts, apparatus, systems, system elements and components thereof may be implemented as part of the computing system described above or as an independent component or components.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A non-transitory computer-readable medium whose contents cause a processing device including a processor, a memory coupled to the processor and a display coupled to the processor to perform a method of selecting an archery sight tape for an archery sight employed with selected archery equipment, the archery sight tape included in a plurality of sight tapes uniquely identified relative to one another, the method comprising:

storing in the memory, for each of the plurality of sight tapes, a first distance separating two sight marks included on each of the plurality of sight tapes, respectively, the two sight marks including a first sight mark associated with a first known shot-distance and a second sight mark associated with a second known shot-distance, wherein each of the respective first known shot-distances are selected to be the same as one another, and wherein each of the respective second known shot-distances are selected to be the same as one another;

providing at least one archery parameter for the selected archery equipment;

determining, by the processor, sight settings for the selected archery equipment based, at least in part, on the at least one archery parameter;

determining, by the processor, a second distance from the sight settings, the second distance separating a first sight setting associated with the first known shot-distance and a second sight setting associated with the second known shot-distance;

comparing, by the processor, a value of the second distance with a value of the respective first distances to determine which of the respective first distances most closely matches the second distance; and providing an identification of an archery sight tape included in the plurality of archery sight tapes having the first distance that most closely matches the second distance.

2. The non-transitory computer readable medium of claim 1, wherein the archery sight includes at least one mechanically operated sight pin.

3. The non-transitory computer readable medium of claim 1, wherein the act of providing the identification includes an act of providing an indicia that uniquely identifies the archery sight tape.

4. The non-transitory computer readable medium of claim 3, wherein the indicia includes a numeric indicia.

5. The non-transitory computer readable medium of claim 3, wherein the indicia includes an alphabetical indicia.

6. A non-transitory computer-readable medium whose contents cause a processing device including a processor, a memory coupled to the processor and a display coupled to the processor to perform a method of selecting an archery sight tape for an archery sight employed with selected archery equipment, the archery sight including a sight pin, the archery sight tape included in a plurality of sight tapes and a setup tape, the method comprising:

storing in the memory, for each of the plurality of sight tapes, a first distance between a first position of the sight pin established for a first known shot-distance and a second position of the sight pin established for a second known shot-distance, respectively, wherein the setup tape includes a first sight mark common to each of the plurality of sight tapes for use at the first known shot-distance, and wherein the setup tape includes a plurality of second sight marks for use at the second known shot-distance, each of the plurality of second sight marks including an indicia that uniquely identifies one of the plurality of sight tapes, respectively;

providing at least one archery parameter for the selected archery equipment;

determining, by the processor, sight settings for the selected archery equipment based, at least in part, on the at least one archery parameter;

determining, by the processor, a second distance from the sight settings, the second distance separating a first sight setting associated with the first known shot-distance and a second sight setting associated with the second known shot-distance;

comparing, by the processor, a value of the second distance with a value of the respective first distances to determine which of the respective first distances most closely matches the second distance; and providing an identification of an archery sight tape included in the plurality of archery sight tapes having the first distance that most closely matches the second distance.

7. The non-transitory computer readable medium of claim 6, wherein the archery sight includes at least one mechanically operated sight pin.

8. The non-transitory computer readable medium of claim 7, wherein the first distance represents a difference in a pin elevation in the archery sight.

9. The non-transitory computer readable medium of claim 8, wherein the second distance represents the difference in the pin elevation in the archery sight.

10. The non-transitory computer readable medium of claim 6, wherein the act of providing the identification includes providing the indicia that uniquely identifies the archery sight tape.

11. The non-transitory computer readable medium of claim 10, wherein the indicia includes a numeric indicia.

12. The non-transitory computer readable medium of claim 10, wherein the indicia includes an alphabetical indicia.

13. A non-transitory computer-readable medium whose contents cause a processing device including a processor, a memory coupled to the processor and a display coupled to the processor to perform a method of selecting an archery sight tape for an archery sight employed with selected archery equipment, the archery sight including a sight pin, the archery sight tape included in a plurality of sight tapes and a setup tape, the method comprising:

storing in the memory, for each of the plurality of sight tapes, a first distance between a first position of the sight pin established for a first known shot-distance and a second position of the sight pin established for a second known shot-distance, respectively, wherein the setup tape provides data employed to determine a numerical value corresponding to each of the first differences, respectively, and wherein each of the respective numerical values uniquely identifies a respective one of the plurality of sight tapes;

providing at least one archery parameter for the selected archery equipment;

determining, by the processor, sight settings for the selected archery equipment based, at least in part, on the at least one archery parameter;

determining, by the processor, a second distance from the sight settings, the second distance separating a first sight setting associated with the first known shot-distance and a second sight setting associated with the second known shot-distance;

comparing, by the processor, a value of the second distance with a value of the respective first distances to determine which of the respective first distances most closely matches the second distance; and providing an identification of an archery sight tape included in the plurality of archery sight tapes having the first distance that most closely matches the second distance.

14. The non-transitory computer readable medium of claim 13, wherein the archery sight includes at least one mechanically operated sight pin.

15. The non-transitory computer readable medium of claim 14, wherein the first distance represents a difference in a pin elevation in the archery sight.

16. The non-transitory computer readable medium of claim 15, wherein the second distance represents the difference in the pin elevation in the archery sight.

17. The non-transitory computer readable medium of claim 10, wherein the act of providing the identification includes outputting the identification for display.

* * * * *